US010619450B2

(12) United States Patent
Richards et al.

(10) Patent No.: US 10,619,450 B2
(45) Date of Patent: Apr. 14, 2020

(54) REMOTELY OPERATED AND MULTI-FUNCTIONAL DOWN-HOLE CONTROL TOOLS

(71) Applicant: HALLIBURTON ENERGY SERVICES, INC., Houston, TX (US)

(72) Inventors: William M. Richards, Flower Mound, TX (US); Syed Hamid, Dallas, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 228 days.

(21) Appl. No.: 15/757,191

(22) PCT Filed: Oct. 2, 2015

(86) PCT No.: PCT/US2015/053778
§ 371 (c)(1),
(2) Date: Mar. 2, 2018

(87) PCT Pub. No.: WO2017/058255
PCT Pub. Date: Apr. 6, 2017

(65) Prior Publication Data

US 2018/0252073 A1 Sep. 6, 2018

(51) Int. Cl.
*E21B 34/10* (2006.01)
*E21B 43/12* (2006.01)
(Continued)

(52) U.S. Cl.
CPC ..... *E21B 34/10* (2013.01); *E21B 34/16* (2013.01); *E21B 41/0085* (2013.01);
(Continued)

(58) Field of Classification Search
CPC ..... E21B 34/10; E21B 43/12; E21B 34/16; E21B 41/0085; E21B 43/088;
(Continued)

(56) References Cited

U.S. PATENT DOCUMENTS

2002/0189814 A1 12/2002 Freiheit et al.
2006/0113089 A1 6/2006 Henriksen et al.
(Continued)

OTHER PUBLICATIONS

Korean Intellectual Property Office, International Search Report and Written Opinion, PCT/US2015/053778, dated Jun. 29, 2016, 13 pages, Korea.

*Primary Examiner* — Wei Wang

(57) ABSTRACT

A system for controlling flow in a wellbore can include a down-hole control module that is hydraulically coupled to multiple components of the system. The control module can include a computer, which can be preprogrammed to operate the various components in a particular sequence, and communicate confirmation or error signals to a surface location. The control module can also include a micro-hydraulic motor and pump that can that can be instructed by the computer to selectively deliver hydraulic fluid to one or more of the components of the system. The system can include isolation members such as packers, hydraulic pressure maintenance devices (PMDs), hydraulic sheer joints, inflow control devices or valves (ICDs or ICVs) and a three-position valve that can be actuated by the control module without necessitating communication with a surface location.

20 Claims, 13 Drawing Sheets

(51) Int. Cl.

| | |
|---|---|
| ***E21B 34/16*** | (2006.01) |
| ***E21B 41/00*** | (2006.01) |
| ***E21B 43/08*** | (2006.01) |
| ***E21B 47/06*** | (2012.01) |
| ***E21B 47/12*** | (2012.01) |
| ***E21B 17/06*** | (2006.01) |
| ***E21B 33/127*** | (2006.01) |
| ***E21B 43/04*** | (2006.01) |
| ***E21B 43/14*** | (2006.01) |
| ***E21B 43/26*** | (2006.01) |
| ***E21B 34/00*** | (2006.01) |

(52) U.S. Cl.
CPC ..... *E21B 43/088* (2013.01); *E21B 43/12* (2013.01); *E21B 47/06* (2013.01); *E21B 47/12* (2013.01); *E21B 17/06* (2013.01); *E21B 33/127* (2013.01); *E21B 43/045* (2013.01); *E21B 43/14* (2013.01); *E21B 43/26* (2013.01); *E21B 2034/007* (2013.01)

(58) Field of Classification Search
CPC ..... E21B 47/06; E21B 47/12; E21B 17/06; E21B 33/127; E21B 43/045; E21B 43/14; E21B 43/26; E21B 2034/007; E21B 34/06; E21B 34/00; E21B 34/066; E21B 43/04
See application file for complete search history.

(56) References Cited

U.S. PATENT DOCUMENTS

| | | | | |
|---|---|---|---|---|
| 2009/0008078 | A1 | 1/2009 | Patel | |
| 2009/0151925 | A1 | 6/2009 | Richards et al. | |
| 2011/0214882 | A1 | 9/2011 | Santos | |
| 2014/0083685 | A1* | 3/2014 | Tips ..... | E21B 47/123 166/250.01 |

* cited by examiner

REMOTELY OPERATED AND MULTI-FUNCTIONAL DOWN-HOLE CONTROL TOOLS

CROSS-REFERENCE TO RELATED APPLICATIONS

This application is a U.S. national stage patent application of International Patent Application No. PCT/US2015/053778, filed on Oct. 2, 2015, the benefit of which is claimed and the disclosure of which is incorporated herein by reference in its entirety.

BACKGROUND

1. Field of the Invention

The present disclosure relates generally to well completion systems, service tools and associated methods utilized in conjunction with hydrocarbon recovery wells. More particularly, embodiments of the disclosure relate to systems, tools and methods employing a down-hole control module for operating a plurality of other down-hole components, e.g., valves, regulators and other flow control tools in a multi-zone well completion system.

2. Background Art

In the hydrocarbon production industry, intelligent well completions have been employed to permit an operator to monitor and control well inflow or injection down-hole. An intelligent completion system generally includes one or more feedback devices, e.g., sensors that detect the nature of down-hole fluids or provide other insights about a down-hole process. The operator can evaluate the sensor data and respond to optimize production from the well and to effectively manage the geologic reservoir over time. For example, the operator can respond by remotely actuating down-hole flow control tools to maintain a desired pressure or flow rate down-hole.

One method for remotely actuating down-hole components includes physical intervention into the well. For example, a ball or dart can be dropped into the wellbore to physically engage a selected down-hole component. The ball or dart can thereby alter the operation of that component, e.g., by activating or deactivating the component. In some instances, this method may not be appropriate due the time it takes for the ball or dart to reach its destination, and also due to a tendency for the ball or dart to get "lost" or otherwise stuck in an unexpected location in the wellbore. Another method of remotely actuating down-hole components includes sending electric or hydraulic signals to the selected down-hole component through control lines extending from the surface. These control lines can occupy space in a wellbore completion that can unnecessarily limit a flow diameter available for producing fluids from the wellbore. Some wireless telemetry systems have also been developed. However, in some applications, e.g., gravel packing operations where significant noise is generated by conveying gravel packing fluids through the wellbore, wireless communication can be unreliable. Accordingly, there remains a need for reliable intelligent wellbore systems.

BRIEF DESCRIPTION OF THE DRAWINGS

The disclosure is described in detail hereinafter on the basis of embodiments represented in the accompanying figures, in which.

DETAILED DESCRIPTION

Figure 1:
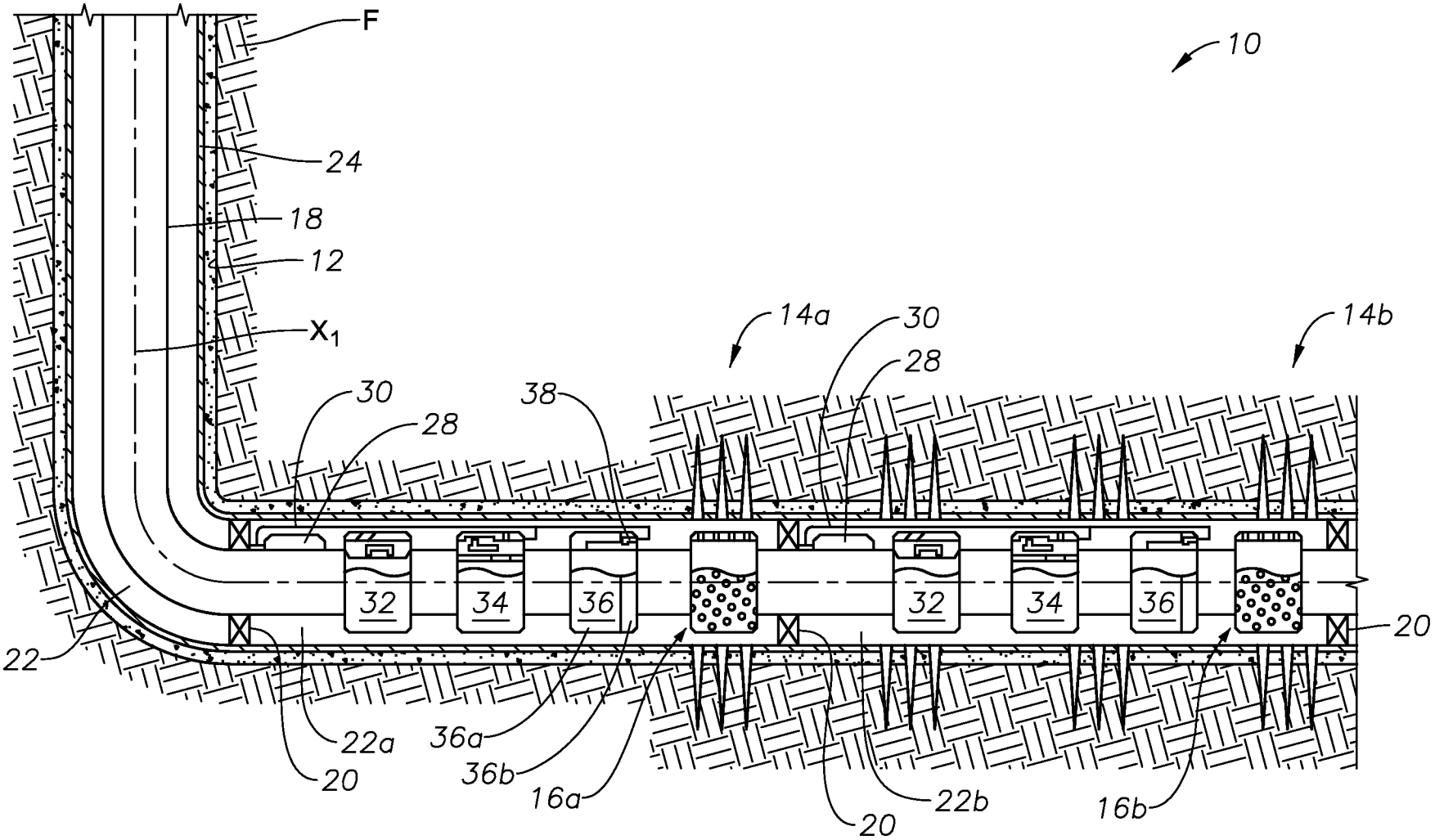
FIG. 1 is a partially cross-sectional schematic view of a multi-zone, cased well completion system including a control module, an isolation member, a circulating valve, a hydraulic pressure maintenance device ("PMD"), and a hydraulic shear joint in each annular zone in accordance with example embodiments of the present disclosure.

In the interest of clarity, not all features of an actual implementation or method are described in this specification. Also, the "exemplary" embodiments described herein refer to examples of the present invention. In the development of any such actual embodiment, numerous implementation-specific decisions may be made to achieve specific goals, which may vary from one implementation to another. Such would nevertheless be a routine undertaking for those of ordinary skill in the art having the benefit of this disclosure. Further aspects and advantages of the various embodiments and related methods of the invention will become apparent from consideration of the following description and drawings.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "up-hole," "down-hole," "upstream," "downstream," and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures.

FIG. 1 illustrates a well completion system 10 in accordance with example embodiments of the present disclosure. In well completion system 10, a wellbore 12 extends through a geologic formation "F" along a longitudinal axis $X_1$. The wellbore 12 intersects a plurality of annular zones 14 (designated in FIG. 1 as annular zones 14*a* and 14*b*) in formation "F." Although only two annular zones 14 are illustrated in FIG. 1, one skilled in the art would recognize that additional annular zones can be established, and similarly, that aspects of the present disclosure can be practiced in a single-zone well system. Well completion system 10 may be used with cased (as shown) or uncased wellbores. Fluid is produced from the annular zones 14 via respective multiple screen systems 16 (designated in FIG. 1 as screen systems 16*a* and 16*b*) disposed along a tubular string 18. Although the disclosure is not limited to a particular screen system, one or more exemplary screen systems are described in greater detail below, e.g., with reference to FIG. 7. Although the portion of the wellbore 12 that intersects the annular zones 14 is depicted as being substantially horizontal in FIG. 1, it should be understood that this orientation of the wellbore 12 is not essential to the principles of this disclosure. The portion of the wellbore 12 which intersects the annular zones 14 could be otherwise oriented (e.g., vertical, inclined, etc.). In some embodiments, the well completion system 10 can have components, procedures, etc., associated therewith, which are similar to those used in the ESTMZ™ (Enhanced Single Trip Multi-Zone) completion system marketed by Halliburton Energy Services, Inc. of Houston, Tex. USA.

The annular zones 14 are isolated from each other in the wellbore 12 by isolation systems 20. As illustrated in FIG. 1 where well completion system 10 is used in a cased wellbore, the isolation systems 20 seal off an annulus 22 formed between the tubular string 18 and casing 24, which lines the wellbore 12. However, if the portion of the wellbore 12 which intersects the annular zones 14 were uncased or open hole, then the isolation systems 20 could seal between the tubular string 18 and a wall of the wellbore, e.g., as described below with reference to FIG. 6. In any event, annular space 22*a*, 22*b* is defined radially around the tubular string 18 and longitudinally between the isolation systems 20 for each respective annular zone 14*a*, 14*b*. Each annular space 22*a*, 22*b* can be selectively maintained at an individual pressure to optimize production from wellbore 12.

In some example embodiments, a respective control module 28 can be associated with each annular zone 14, along with other down-hole flow control tools utilized with the annular zone, which down-hole flow control tools may include an isolation system 20, a circulating valve 32, a pressure management device ("PMD") 34 (examples of which are described below with reference to FIGS. 3 and 4), and a hydraulic shear joint 36. As illustrated in FIG. 1, each control module 28 can be coupled by control lines 30 to an isolation system 20, a PMD 34, and a hydraulic shear joint 36 of each annular zone 14. In some embodiments, e.g., those described below with reference to FIGS. 6 through 8, the control modules 28 of a particular annular zone 14 can also be operably coupled to inflow control mechanisms within the screen system 16 associated with the annular zone.

The control modules 28 are operable to provide one or more of hydraulic pressure, electrical power, data and other signals through the control lines 30 to independently actuate, operate, or otherwise change an operational configuration of one or more of the down-hole flow control tools of the well completion system 10. The control lines 30 can include any passage or media through which control signals can be sent between the control modules 28 and the flow control tools of the well completion system 10.

For example, the isolation systems 20 can be actuated by receiving hydraulic fluid from the control modules 28 in a predetermined sequence of pressure increases and pressure holds, (e.g. maintaining a supplied pressure for a predetermined time period), to thereby set the isolation systems 20 in the annulus 22. In some embodiments, each of the isolation systems 20 may include a sealing member (see, e.g., sealing member 212 described below with reference to FIG. 6) and a hydraulically-activated setting mechanism (see, e.g., setting mechanism 214 described below with reference to FIG. 6) that is responsive to pressure changes in the control lines 30 to urge the sealing member of the isolation system 20 into a sealing engagement with the casing 24 (or wellbore wall, as the case may be). In some embodiments, the sealing member of an isolation system may be inflatable and the setting mechanism of an isolation system 20 may include a valve in fluid communication with a pressurized fluid, e.g., a fluid within annular space 22*a* or 22*b*, where receipt of hydraulic fluid from the control modules 28 opens the valve and thereby permits the pressurized fluid to inflate the inflatable sealing members. One suitable isolation system 20 is the VERSA-TRIEVE® packer marketed by Halliburton Energy Services, Inc., although the use other types of packers is contemplated.

Likewise, the control modules 28 may be utilized to actuate circulating valves 32 to selectively permit or restrict fluid flow, such as, for example, to circulate flow into the annular space 22 of an annular zone 14. In some embodiments, the circulating valves 32 can facilitate gravel packing operations, such as in crossover gravel packing operations. Generally in gravel packing operations, a gravel pack fluid is conveyed down-hole to the annular space 22*a*, 22*b* or other area to be gravel packed. The gravel pack fluid includes a carrier fluid having gravel particulates suspended therein. The gravel particulates can include course gravels, fine sands or combinations thereof depending on the design criteria specified, e.g., filtration or geologic formation support characteristics. As the gravel pack fluid flows into an annular space 22 around a screen, the gravel particulates are deposited from the carrier fluid into the wellbore, and the carrier fluid is returned or conveyed up-hole to a surface location. In a crossover gravel packing operation, a gravel pack fluid flows down to the location for the gravel pack through an interior passage 56 (see FIG. 2A) of the tubular string 18, and thereafter is directed to the annular region 22*a*, 22*b* to be gravel packed through a circulating valve 32. The return carrier fluid then flows through the screens and up a washpipe (see, e.g., washpipe 430 described below with reference to FIG. 10A) where the fluid is directed back into the annulus 22 above the isolation system 20 and allowed to flow back to the surface. Although some embodiments of a wellbore completion system 10 have been described in which circulating valves 32 are used in gravel packing operations, other fluid operations and implementations, e.g., hydraulic fracturing operations, are contemplated as well.

The circulating valves 32 can be moved between open and closed operational configurations, and in some embodiments, can be operable by physical intervention, e.g., dropping balls or shifting a service tool. In some embodiments, the circulating valves 32 can be operable by the control modules 28.

The shear joints 36 are interconnected in the tubular string 18, and are coupled to and controlled by the respective control modules 28, to allow the tubular string 18 to be at least partially parted at, if not completely sheared by, the shear joint 36, as desired. For example, the shear joint 36 can be actuated by control module 28 to provide stress relief or flexibility to the tubular string 18 by permitting relatively unrestricted displacement between separable portions 36*a*, 36*b* of the shear joint 36. Alternatively or additionally, e.g., in the event that an isolation system 20 or other equipment becomes stuck in the wellbore 12, the shear joint 36 can be actuated by control module 28 to completely sever the tubular sting 18 such that the portion of tubular string 18 above the shear joint 36 can be readily retrieved from the wellbore 12. In some embodiments, fluid isolation is maintained between the tubing and annulus fluids throughout the operation of the shear joint 36, e.g., by sealing members (not shown) provided with, and/or activated by, the shear joint 36.

In some example embodiments, the shear joints 36 each comprise the pair of separable portions 36*a*, 36*b* and a locking member 38 that prevents relative displacement between the separable portions 36*a*, 36*b* in at least one direction. In one or more embodiments, the locking member 38 is a shear pin that is operable to shear in response to the delivery of a predetermined level of hydraulic pressure to the shear joint 36 from control module 28 through control lines 30. When the locking member 38 is sheared, relatively unrestricted up-hole displacement of the separable portion 36*a* from the separable portion 36*b* is permitted. In one or more embodiments, locking member 38 may be a latch, clamp or another connector that is hydraulically or electrically activated by the control module 28 to permit separation of the separable portions 36*a*, 36*b*.

Figure 2A:
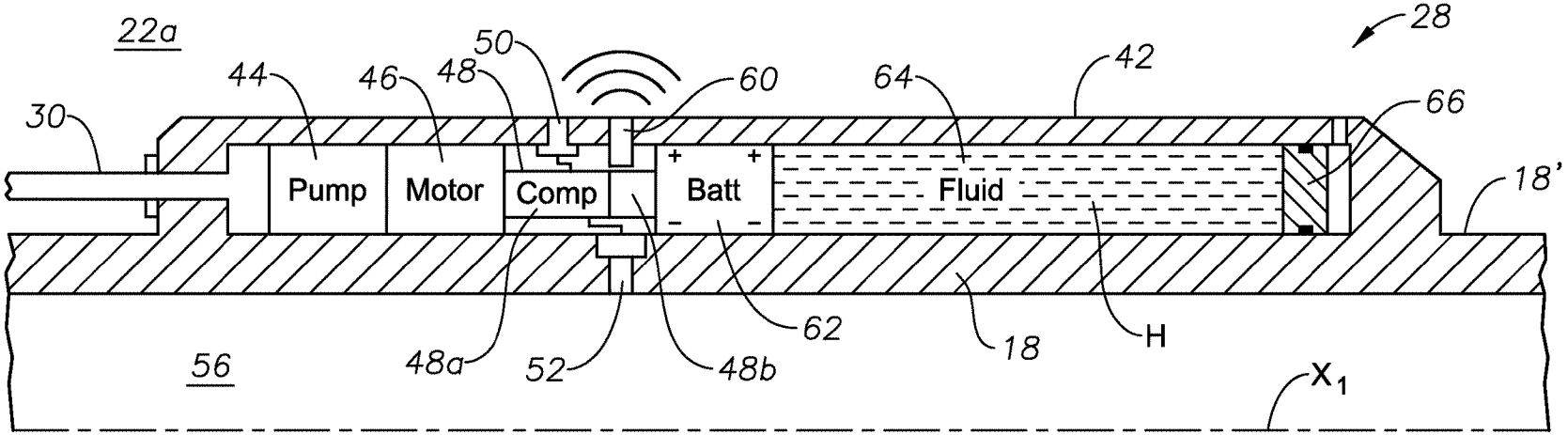
FIG. 2A is a schematic view of the control module of FIG. 1 illustrating a reservoir for hydraulic fluid and hydraulic control lines extending from the control module.

Referring to FIG. 2A, one embodiment of the control module 28 is depicted, and includes a housing 42 from which the control lines 30 extend. As illustrated, the housing 42 is coupled to an exterior surface of an annular sidewall 18' defined by the tubing string 18. Housing 42 may be integrally formed as part of sidewall 18' or may be separately formed. Other mounting locations for the control module 28 are also contemplated. The control lines 30 are illustrated schematically as a single conduit, however, the control lines 30 can include a plurality of lines 30 (see FIG. 2B) that can be individually routed to the various down-hole flow control tools of well completion system 10 (FIG. 1).

A pump 44 is coupled to the control lines 30 within the housing 42. The pump 44 is operably coupled to a motor 46, which can selectively drive the pump 44 to provide a pressurized hydraulic fluid "H" to the control lines 30. In one or more embodiments, pump 44 and motor 46 include, or are part of, small diameter pump systems, such as down-hole ram-pump systems, or down-hole hydraulic pump systems. These small diameter pump systems are referred to as "micropumps" since the pump 44 and motor 46 are commonly characterized by diameters of about one half inch or less. In any event, the motor 46 is operatively and communicatively coupled to a controller 48, such that the controller 48 can selectively instruct the motor 46 and pump 44, and receive feedback therefrom.

In some embodiments, the controller 48 may include a computer having a processor 48*a* and a computer readable medium 48*b* operably coupled thereto. The computer readable medium 48*b* can include a nonvolatile or non-transitory memory with data and instructions that are accessible to the processor 48*a* and executable thereby. In one or more embodiments, the computer readable medium 48*b* is pre-programmed with a predetermined threshold pressure for a particular annular zone 14*a*, 14*b* (FIG. 1). The predetermined threshold pressure may be selected based on the location of the particular annular zone 14*a*, 14*b* within the wellbore 12, and the pressure of fluids in the geologic formation "F" (a formation pressure) adjacent the particular annular zone 14*a*, 14*b*. The predetermined threshold pressure can be selected to establish an overbalance condition within the particular annular zone 14*a*, 14*b* to prevent the fluids in the geologic formation "F" from prematurely entering the wellbore 12. The computer readable medium 48*b* may also be pre-programmed with predetermined sequences of instructions for operating the motor 46 and pump 44 for to achieve various objectives, and other information as described in greater detail below.

In one or more embodiments, control module 28 also includes one or more feedback devices 50, 52. The controller 48 is communicatively coupled to feedback devices 50, 52. The feedback devices 50, 52 are operable to detect and/or react to an environmental characteristic, and to provide a feedback signal representative of the environmental characteristic to the controller 48. In one or more embodiments, one or more of the feedback devices 50 are pressure feedback devices operable to detect and/or react to an environmental characteristic from which an environmental pressure is determinable or estimable. As used herein, the term "representative" means at least that one signal, pressure or quantity is directly correlated, associated by mathematical function, and/or otherwise determinable or estimable from another signal pressure or quantity. In one or more embodiments, a first pressure feedback device 50 may be positioned to measure pressure within the annulus. More specifically, pressure feedback device 50 is disposed on an outer diameter of housing 42 such that pressure feedback device 50 can be operatively exposed to the annular space 22*a* on the exterior of the tubular string 18. A second pressure feedback device 52 may be positioned to measure pressure within an interior of well completion system 10. More specifically, feedback device 52 is disposed on an inner diameter of the housing 42 such that the feedback device 52 can be operatively exposed to an interior passage 56 extending longitudinally, e.g., along longitudinal axis $X_1$, through the tubular string 18. In exemplary embodiments, the annulus feedback device 50 and tubular feedback device 52 can comprise pressure sensors, flow rate sensors, or other mechanisms operable to provide pressure signals to the controller 48 that are representative of the environmental pressure to which the respective pressure feedback device 50, 52 is exposed.

A communication unit 60 may be provided in operative communication with the controller 48. In some embodiments, the communication unit 60 can serve as both a transmitter and receiver for communicating signals between the control module 28 and a surface location or other components of well completion system 10. For example, the communication unit 60 can transmit an error signal to an operator at the surface in the event the controller 48 determines that any component of the well completion system 10 is not functioning within a predetermined set of parameters.

The communication unit 60 can also serve as a receiver for receiving data or instructions from the surface location or from other components of the well completion system 10. For example, the communication unit 60 can receive a unique "START" signal from an operator at the surface, and transmit the "START" signal to the controller 48 to induce the controller 48 to execute a particular predetermined sequence of instructions stored on the computer readable medium 48*b*. In one or more exemplary embodiments, the signals transmitted to the surface location may include signals representative of a state of the system 10. For example, signals representative of the position of one of the closure member(s) 74, 88, 444 described below, or any other controlled components may be transmitted to the surface. In some embodiments, the signals received from the surface location may include supervisory, overriding signals that permit an operator to control the closure member(s) 74, 88, 444 or other controlled components regardless of any instructions provided by the controller 48. In some embodiments, communication unit 60 comprises a wireless device such as a hydrophone or other types of transducers operable to selectively generate and receive acoustic signals. In some embodiments, communication unit 60 can comprise other wired or wireless telemetry tools as will be appreciated by those skilled in the art.

A power source 62 is provided to supply energy for the operation of the pump 44, motor 46, controller 48, feedback devices 50, 52, communication unit 60 and/or other components of the control module 28 and well completion system 10. In some embodiments, power source 60 comprises a battery that is self-contained within the housing 42 while in other embodiments, power source 60 may be a self-contained a turbine operable to generate electricity responsive to the flow of wellbore fluids therethrough. In some embodiments, power source 60 comprises a connection with the surface location, e.g., an electric or hydraulic connection to the surface location through which power for the control module 28 can be provided.

Also disposed within the housing 42 of the control module 28 is a tank, volume or reservoir 64 for containing a supply of hydraulic fluid "H," and a compensator 66 operably coupled to the reservoir 64. In some embodiments, the reservoir 64 can be formed from any volume within the control module 28, including, e.g. a volume within the pump 44 and/or control lines 30. The compensator 66 can comprise a balanced piston compensator for offsetting variations in the volume of the hydraulic fluid "H," e.g., variations that can be associated with changes in temperature within the wellbore 12.

Figure 2B:
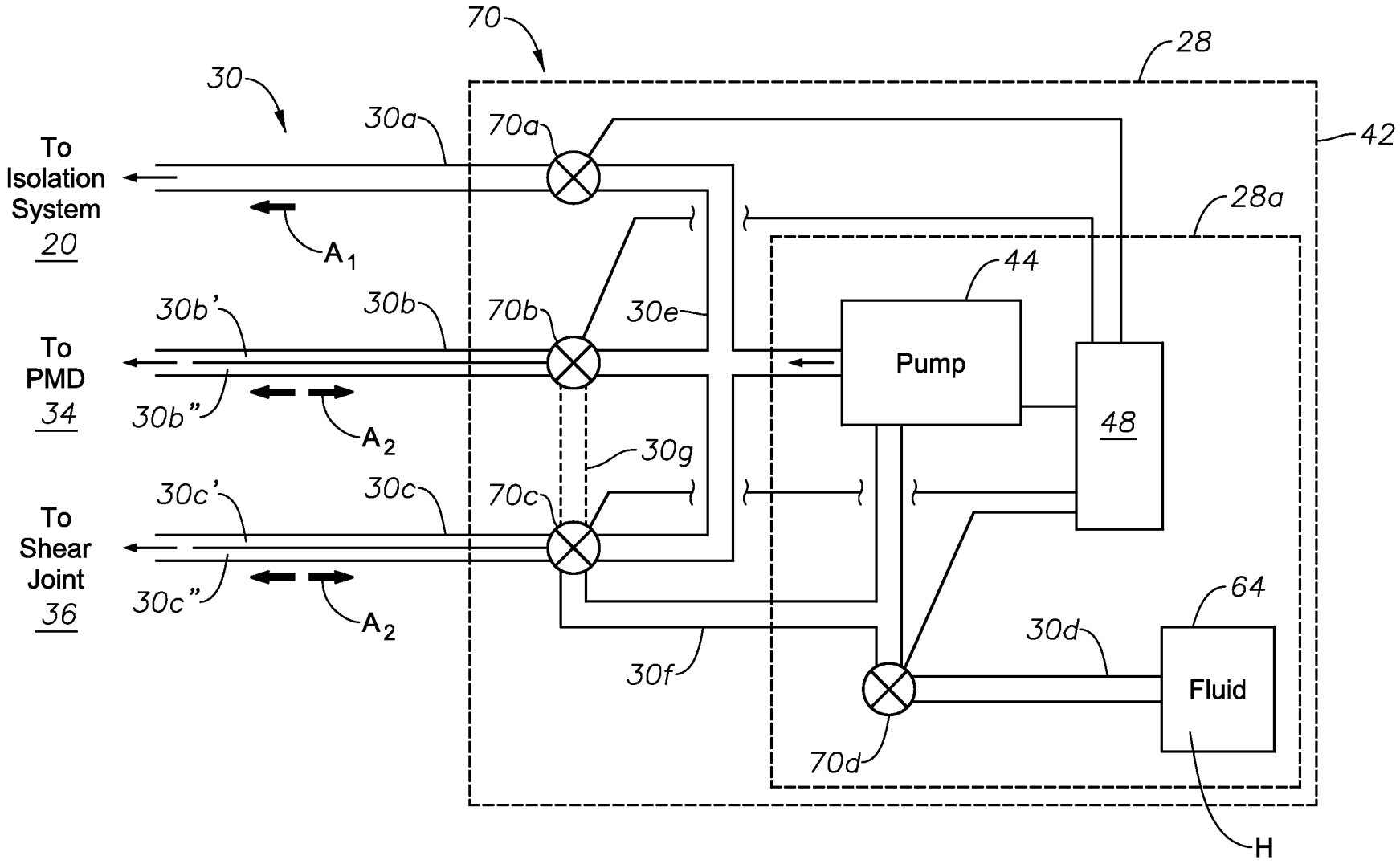
FIG. 2B is a schematic view of an example hydraulic fluid system operable to distribute hydraulic fluid of FIG. 2A among the hydraulic control lines of FIG. 2A.

As illustrated in FIG. 2B, a hydraulic fluid system 68 is provided for distributing hydraulic fluid "H" among the hydraulic control lines 30. A hydraulic control line 30*a* extends from the control module 28 to the isolation system 20 (FIG. 1), a control line 30*b* extends to PMD 34 (FIG. 1) and a control line 30*c* extends to the shear joint 36 (FIG. 1). The control line 30*a* can comprise a single passage control line 30 for providing hydraulic fluid "H" to the isolation system 20 from the control module 28 in a single direction as indicated by arrow $A_1$. Hydraulic fluid "H" can be provided through the control line 30*a* to thereby provide a working pressure to the isolation system 20 for setting the isolation system 20. The control lines 30*b* and 30*c* can comprise dual control lines 30 extending from the control module 28. The dual control lines 30*b* and 30*c* can each comprise a pair of passages, e.g., passages 30*b*', 30*b*" and passages 30*c*' and 30*c*" disposed therein. Dual control lines 30*b* and 30*c* permit hydraulic fluid "H" to be provided in dual directions, e.g., toward and away from control module 28 as indicated by arrows $A_2$. Operation of the PMD 34 and/or the shear joint 36 can include a return of hydraulic fluid "H" to the control module 28 as described in greater detail below, e.g., with reference to FIGS. 3 and 5. While hydraulic fluid system 68 is illustrated with three control lines 30*a*, 30*b* and 30*c* communicating with three different sub-systems of well completion system 10, in one or more embodiments, a lesser or greater number of control lines 30 and corresponding sub-systems may be provided.

A pump input control line 30*d* extends between reservoir 64 and pump 44 to permit hydraulic fluid "H" to be introduced to the pump 44 from the reservoir 64. Pump output control lines 30*e* extend from the pump 44 to each of the control lines 30*a*, 30*b* and 30*c* such that the single pump 44 can provide hydraulic fluid "H" under pressure to each of the control lines 30*a*, 30*b* and 30*c*. Return control lines 30*f* and 30*g* extend from the dual control lines 30*b* and 30*c* to permit hydraulic fluid "H" to be received from the passages 30*b*', 30*b*", 30*c*' and 30*c*" and to be introduced to the pump input control line 30*d*.

A plurality of valves 70 is provided to selectively distribute the hydraulic fluid "H" among the control lines 30*a* through 30*g*. A respective valve 70*a*, 70*b*, 70*c* is provided within each of the control lines 30*a*, 30*b*, 30*c*, and a master valve 70*d* is provided within the supply line 30*d*. Valves 70*a* and 70*d* can be opened or closed to selectively permit or restrict flow of the hydraulic fluid "H" therethrough. Valves 70*b* and 70*c* can also be opened and closed, and can additionally operate to selectively determine a flow direction of hydraulic fluid "H" through each of the dual passages 30*b*', 30*b*", 30*c*' and 30*c*". For example, valve 70*b* can operate to couple one of the passages extending thereto, e.g., passage 30*b*' to the pump output control line 30*e* and the other passage, e.g., passage 30*b*" to the appropriate return control line 30*g*. Each of the valves 70*a* through 70*d* can be operatively coupled the controller 48 (FIG. 2A), and can be instructed thereby to move to a particular position or operational configuration.

In the example embodiments illustrated by FIG. 2B, each of the valves 70*a* through 70*d* can be disposed within the housing 42 of control module 28. In some embodiments, a control module 28*a* is provided that houses a subset of or none the valves 70*a* through 70*d*. It should be appreciated that the location of the valves 70*a* through 70*d* can be at any point along the control lines 30.

Figure 3:
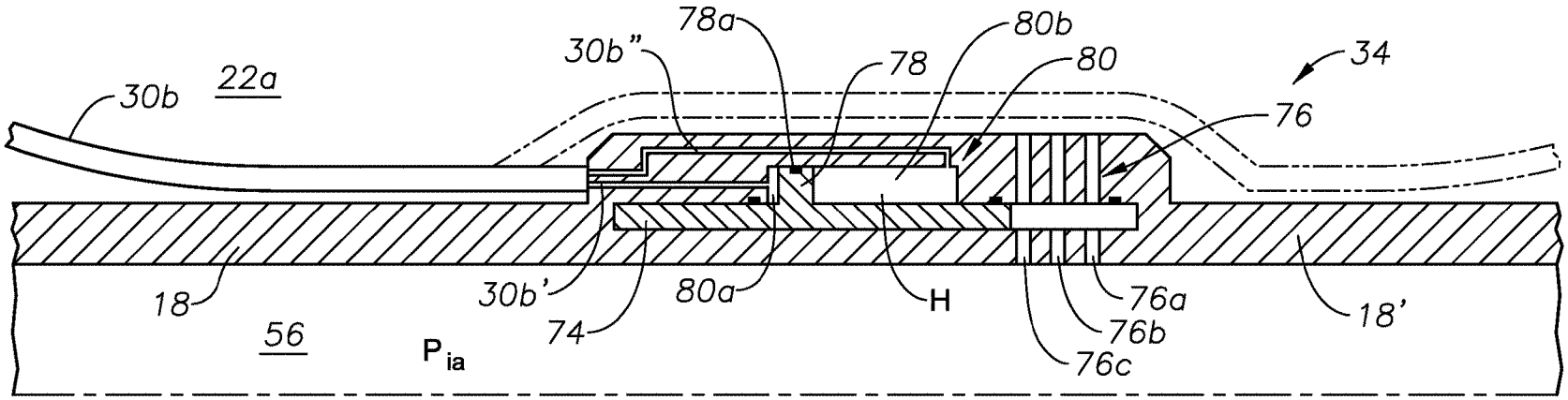
FIG. 3 is a schematic view of the hydraulic PMD of FIG. 1.

Referring to FIG. 3, a schematic cross-section of PMD 34 is illustrated. Generally, the PMD 34 is operable to selectively permit a portion of a fluid from within interior passage 56 to flow into annular space 22*a*, and thereby increase a zonal pressure $P_z$ within the annular space 22*a*. In some embodiments, when the zonal pressure $P_z$ reaches a predetermined threshold pressure, thereafter, PMD 34 limits or stops flow into the annular space 22*a* to prevent overpressurization of the annular space 22*a*.

In some embodiments, when the zonal pressure $P_z$ falls below the predetermined threshold pressure, the PMD 34 operates to again permit fluid to flow from the interior passage 56 into the annular space 22*a*. In some other embodiments, the PMD 34 operates to continue to limit or stop flow into the annular space 22*a* until the zonal pressure $P_z$ falls below a predetermined limit pressure that is lower than the predetermined threshold pressure. As described in greater detail below, by defining a predetermined limit pressure that is substantially distinct from the predetermined threshold pressure, the PMD 34 will not "chatter" when the zonal pressure is very near the predetermined threshold pressure.

The PMD 34 includes a closure member 74 and an opening 76 extending through the sidewall 18' of the tubular string 18. The opening 76 includes a plurality of discrete nozzles 76*a*, 76*b* and 76*c*, although a single elongate slot and other configurations for the opening 76 are also contemplated. The closure member 74 is selectively movable between an open position (illustrated in FIG. 3) and a closed position. With the closure member 74 in the open position, fluid flow through at least some of the nozzles 76*a*, 76*b*, 76*c* is permitted between interior passage 56 and annular space 22*a*, and when the closure member 74 is in the closed position, the closure member 74 extends through or across the nozzles 76*a*, 76*b*, 76*c*, and fluid flow through the opening 76 is obstructed.

The closure member 74 includes a piston 78 extending into a fluid chamber 80. The piston 78 can be described as a "dual-action" piston as the fluid chamber 80 is axially divided into two sections 80*a*, 80*b* by the piston 78. The two sections 80*a*, 80*b* are fluidly isolated from one another by a seal 78*a* carried by the piston 78. Each section 80*a*, 80*b* is fluidly coupled to a respective one of the passages 30*b*', 30*b*" extending through the dual control line 30*b*. The piston 78

A command signal can be transmitted to the PMD 34 by selectively providing hydraulic fluid "H" to one of the two sections 80*a*, 80*b* to move the closure member 74 to the open position, the closed position, and any position therebetween. For example, providing hydraulic fluid "H" under pressure to the section 80*a* causes the hydraulic fluid "H" to apply pressure to the piston 78, and thereby move the closure member 74 in an axial direction toward the nozzles 76*a*, 76*b*, and 76*c*. A sufficient quantity of hydraulic fluid "H" can be provided such that an appropriate number of the nozzles 76*a*, 76*b*, and 76*c* are obstructed by the closure member 74 to establish a desired flow rate through the opening 76. When a quantity of hydraulic fluid "H" is provided through passage 30*b*' to section 80*a*, a corresponding quantity of hydraulic fluid "H" can be returned through passage 30*b*" from section 80*b*. Similarly, the closure member 74 can be moved in an opposite axial direction by supplying hydraulic fluid "H" to section 80*b* and returning hydraulic fluid from 80*a*. In this manner, the closure member 74 can be moved to, and maintained in, any position between the open and closed positions. Generally, any of the closure members (e.g., closure members 74, 88, 444) or other components described herein as being selectively movable between open and closed positions, may also be moved to, and maintained in, any position between the open and closed positions, unless otherwise stated.

Figure 4:
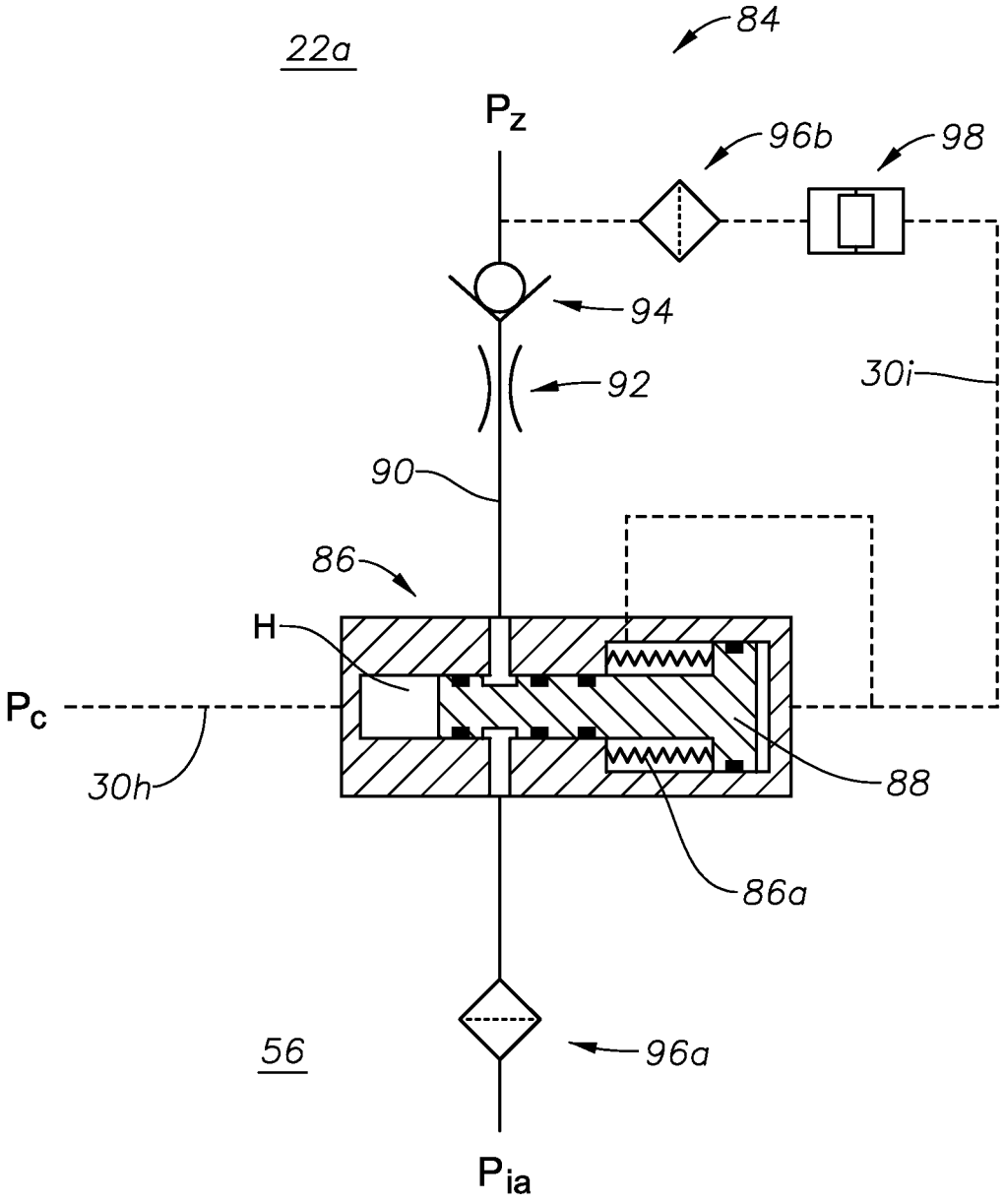
FIG. 4 is a schematic view of a hydraulic PMD in accordance with example embodiments of the present disclosure.

Referring now to FIG. 4, a PMD 84 in accordance with alternate embodiments of the disclosure is depicted schematically disposed between the interior passage 56 and the annular space 22*a*. An environmental pressure within the interior passage 56 is represented by $P_{ia}$ (inner annulus pressure) and the zonal pressure within the annular space 22*a* is again represented by $P_z$ (zonal pressure). The PMD 84 includes a valve 86 having a closure member 88 therein. The closure member 88 is selectively movable between open and closed positions for respectively permitting and obstructing fluid flow through an opening 90 that extends between the interior passage 56 and annular space 22*a*. In some embodiments, a diameter of the opening 90 can be in the range of about 0.125 inches (approximately 3 mm) to about 2.0 inches (approximately 51 mm) In some embodiments, the valve 86 is configured to maintain the closure member 88 in a normally closed position, and is operable to move the closure member 88 to the open position in response to receiving a control pressure $P_c$ or other command signal through control line 30*h*.

In some embodiments, the control pressure $P_c$ can comprise a hydraulic fluid "H" provided at a pressure generated by the pump 44 of the control module 28 (FIG. 2A). The control pressure can be representative of a predetermined threshold pressure, and the control $P_c$ pressure can operate to urge the closure member 88 toward the open position. A feedback loop is provided through control line 30*i* permit the zonal pressure $P_z$ to counteract the control pressure $P_c$ on the closure member 88. The zonal pressure $P_z$ or a feedback pressure representative of the zonal pressure $P_z$, serves to urge the closure member in a direction toward the closed position. Thus, in some embodiments, when the zonal pressure $P_z$ reaches the predetermined threshold pressure, the feedback pressure is sufficient to overcome the control pressure $P_c$, and the feedback pressure serves to move the closure member 88 to the closed position. In some embodiments, the valve 86 can include springs 86*a* or other mechanisms therein that urge the closure member 88 toward either the open or closed position, and thereby at least partially define the control pressure $P_c$ or feedback pressure required to move the closure member 88 to the open or closed position.

The PMD 84 also includes a hydraulic resistor 92 and a check valve 94 provided within the opening 90. The hydraulic resistor 92 limits a flow rate through the opening 90 when the closure member 88 is in the open position, and the check valve 94 ensures one-way flow through the opening 90 in a direction from the interior passage 56 to the annular space 22*a*. Filters 96*a* and 96*b* are provided within the opening 90 and control line 30*i*, respectively. Filters 96*a* and 96*b* serve filter any fluid entering the PMD 84 from the interior passage 56 and the annular space 22*a*. In some embodiments, the filter 96*a* can be relatively course and the filter 96*b* can be relatively fine as the fluid within the interior passage 56 can be dirtier than fluid within the annular space 22*a*. A compensator 98 is also provided within the control line 30*i* to offset variations in the volume of the fluid entering the PMD 84 from the annular space 22*a*.

Figure 5:
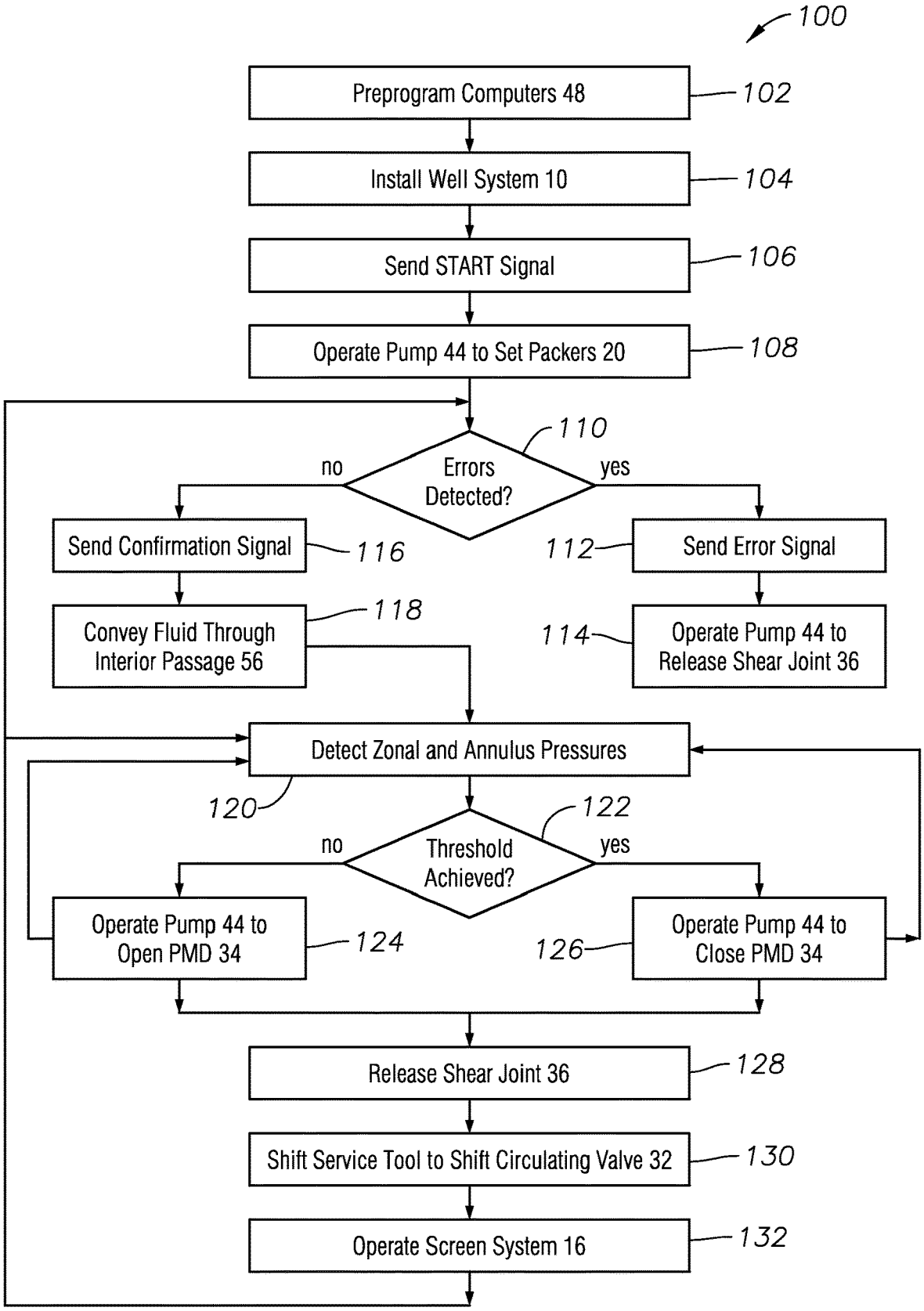
FIG. 5 is a flowchart illustrating a method of operating the well completion system of FIG. 1 in accordance with example embodiments of the present disclosure.

Referring now to FIG. 5, and with continued reference to FIGS. 1-4, an operational procedure 100 illustrates example embodiments of methods for controlling flow in wellbore 12. Initially, at step 102, parameters associated with the control of fluid flow in wellbore 12 are determined. These parameters may include identifying one or more annular zones 14 in the wellbore 12 for production of hydrocarbon, identifying the vertical depths or longitudinal locations for each annular zone 14, identifying the formation pressures associated with each annular zone 14, and identifying conditions for fluid flow through each annular zone 14. As part of step 102, a controller 48 in each control module 28 can be preprogrammed based on this these parameters by installing instructions and data onto the respective computer readable medium 48*b*. The instructions can include instructions for executing any or all of the steps of the operational procedure 100, as described below, and the data can include a predetermined threshold pressure at which each of the annular zones 14*a*, 14*b* is to be maintained. Each controller 48 can be individually preprogrammed with a different threshold pressure and/or limit pressure such that each annular zone 14*a*, 14*b* can be maintained at an individual zonal pressure $P_z$. Thus, in one or more embodiments, it will be appreciated that desired vertical depth or longitudinal location for each annular zone 14 is determined and then the formation pressure adjacent the vertical depth or longitudinal location for each annular zone 14 is identified. The predetermined threshold pressure is then selected to ensure that the individual zonal pressure $P_z$ is balanced or overbalanced in order to prevent formation fluids from prematurely migrating into an individual annular zone 14*a*, 14*b*. Next, the well completion system 10 can be installed in the wellbore 12 (step 104) by running it into the wellbore 12 until the appropriate equipment is positioned at the desired vertical depth or longitudinal location. In some embodiments, the predetermined threshold pressure and/or limit pressure can also be updated or programmed onto the computer readable medium 48*b* when the well completion system 10 is installed in the wellbore 12, e.g., by transmitting signals from the surface location to the communication unit 60, which are recognized by the processor 48*a* as instructions to update the predetermined threshold pressure and/or limit pressure.

At step 106, a signal, such as a "START" signal may be generated to activate various tools of well completion system 10 once installed. In one or more embodiments, the signal is transmitted to the communication unit 60 in order to initiate operation of the well completion system 10. In one or more embodiments, an operator at the surface can send a "START" signal to the communication unit 60 within the each annular zone 14*a*, 14*b* or to any subset of the communication units 60 of the well completion system 10. In other embodiments, the "START" signal may be automatically generated (either locally or transmitted from the surface) when certain conditions related to the well completion system 10 exist. For example, the well completion system 10 may reach the desired vertical depth or longitudinal location, thereby causing a latch (not shown) to be engaged and triggering the transmission of a "START" signal. Thus, the "START" signal may be locally generated or transmitted from within the wellbore 12.

In one or more embodiments, the communication units 60 receive the "START" signals, and transmit the "START" signals to the respective controllers 48 and the processors 48*a* execute instructions stored on the computer readable medium 48*b*.

In any event, once conditions are met for continuing with operational procedure 100, at step 108, isolation systems 20 may be actuated to set sealing members in order to create zones 14. In some embodiments, isolation systems 20 are responsive to receiving the "START" signal, to set the isolation systems 20. To set the isolation systems 20, the controllers 48 operate valves 70 (FIG. 2B) to place valve 70*a* and 70*d* in open configurations, and valves 70*b*, 70*c* in closed configurations. The pump 44 is then operated to provide hydraulic fluid "H" from the reservoir 64 to the isolation systems 20 through control lines 30*a*. Instructions stored on the computer readable medium 48*b* are executed to cause the pump 44 to supply the hydraulic fluid "H" in a predetermined sequence of pressure increases and pressure holds to urge the isolation systems 20 into a sealing engagement with the casing 24 and the tubular string 18.

Once isolation systems 20 are set in accordance with step 108, such as for example, by executing instructions for setting the isolation systems 20, the controller 48 can determine at step 110 if conditions are met for continuing with operational procedure 100. This determination may involve querying various sensors or other systems of well completion system 10. Such queries may indicate if conditions are not met for continuing operation, i.e., an error exists. The controller 48 can query locations such as sensors (see, e.g., feedback device 214*c* discussed below with reference to FIG. 6) at the isolation systems 20, the pressure feedback devices 50, 52, or other locations where signals indicative of errors in setting the isolation systems 20 (or signals indicative of a proper setting of the isolation system) can be found, as understood by those skilled in the art. In some embodiments, an error can be detected if the pressure feedback devices 50, 52 indicate that the zonal pressure $P_z$ and/or the inner annulus pressure annulus pressure $P_{ia}$ falls outside a predetermined pressure range. In some embodiments, the controllers 48 can also simultaneously check for errors in other components of the well completion system 10.

If errors are detected at decision 110, at step 112, an error signal may be generated. The error signal may result from the controller 48 instructing the communication unit 60 to transmit the error signal. The error signal may be transmitted to one or more of the operator at the surface, to other controllers 48 or to other wellbore tools. In some embodiments, the controller 48 can await further instructions (such as from the operator, other controllers or other wellbore tools). In one or more embodiments, if an error is detected, step 112 may be eliminated and the controller 48 can automatically proceed to operate the pump 44 to release the shear joint 36 (step 114). Alternatively, controller 48 can wait for receipt of the error signal. The controller 48 can operate valves 70 (FIG. 2B) to place valve 70*c* and 70*d* in open configurations, and valves 70*a* and 70*b* in closed configurations. Then, the controller 48 can instruct the pump 44 to operate to thereby provide hydraulic fluid "H" to the shear joint 36. Although the shear joint 36 has been described as operable in response to the detection of errors, operation of the shear joint 36 in normal operation of the well completion system 10 is also contemplated for providing strain relief or to achieve other objectives. For example, if no errors are detected at the decision step 110, the shear joint 36 may be released once gravel packing operations for a particular zone 14 are complete (see step 128 described below).

If no errors are detected at decision 110, at step 116, the controller 48 can instruct communication unit 60 to send a confirmation signal to one or more of the operator at the surface, to other controllers 48 or to other wellbore tools to indicate that gravel packing operations can begin. Alternatively step 116 can be eliminated, such that if no errors are detected at step 110, then the gravel packing operation may begin automatically. For example, the controller 48 can send a command signal to a valve, pump, or other tool (not shown) to convey a gravel packing fluid through the interior passage 56 (step 118). In some embodiments, the gravel packing fluid can be conveyed at a pressure greater than any of the predetermined threshold pressures preprogramed into the controllers 48 at step 102. Next, the pressure feedback devices 150, 152 can detect the zonal pressure $P_z$ and the inner annulus pressure $P_{ia}$ (step 120). Signals representative of these pressures $P_z$, $P_{ia}$ can be transmitted to the controller 48, and the controller 48 can determine whether the predetermined threshold pressure (or the predetermined limit pressure) for each zone has been achieved (decision 122).

If the controller 48 determines that the zonal pressure $P_z$ in a particular zone 14*a*, 14*b* is lower than the predetermined threshold pressure and/or limit pressure for that zone 14*a*, 14*b*, the controller 48 instructs pump 44 to move the closure member 74 of PMD 34 to an open position (step 124). The controller 48 can evaluate a differential pressure between the zonal and inner annulus pressures $P_z$, $P_{ia}$, and based on the differential pressure, determine the degree to which the PMD 34 is to be opened, e.g., the number of nozzles 76*a*, 76*b*, 76*c* that should be opened and the number that should be closed or obstructed by the closure member 74. To move the closure member 74, the controller 48 can operate the plurality of valves 70 to place valve 70*b* and 70*d* in open configurations, and valves 70*a* and 70*c* in closed configurations. The controller 48 can also operate valve 70*b* to fluidly couple passage 30*b*" to pump output control line 30*e* and passage 30*b*' to return control line 30*g*. Then, the controller 48 can instruct the pump 44 to operate to provide hydraulic fluid "H" to the chamber 80*b* of PMD 34 through the passage 30*b*", thereby moving the closure member 74 to the determined open position. When the closure member 74 is in the open position, fluid from the interior passage 56 can flow through the PMD 34 in each zone 14 into the respective annular space 22*a*, 22*b*, thereby increasing the zonal pressures $P_z$.

If the controller 48 determines that the zonal pressure $P_z$ in a particular zone 14*a*, 14*b* is equal to or higher than the predetermined threshold pressure for that zone 14*a*, 14*b*, the controller 48 can instruct pump 44 to move the closure member 74 of PMD 34 to the closed position (step 126). The controller 48 can operate valve 70*b* to fluidly couple passage 30*b*' to pump output control line 30*e* and passage 30*b*" to return control line 30*g*. Then, the controller 48 can instruct the pump 44 to operate to provide hydraulic fluid "H" to the chamber 80*a* of PMD 34 through the passage 30*b*', thereby moving the closure member 74 to closed position. Moving the closure member 74 to the closed position prevents over-pressurization of the annular spaces 22*a*, 22*b*.

If the controller 48 determines at decision 122 that the zonal pressure $P_z$ in a particular zone 14*a*, 14*b* is between the predetermined threshold pressure and the predetermined limit pressure, the controller 48 can instruct pump 44 to skip steps 124 or 126 and maintain the closure member 74 of PMD 34 in its current open, closed or intermediate position. In this manner, the controller 48 may be configured to apply the principle of hysteresis to the PMD 34 to avoid unwanted rapid switching of the closure member 74 between positions. Generally, any of the predetermined threshold pressures described herein may be associated with a predetermined limit pressure as well such that the controller 48 may apply the principle of hysteresis to any of the controlled components.

The procedure 100 can proceed from decision 122 or steps 124 and/or 126 back to step 120. The zonal and inner annulus pressures $P_z$, $P_{ia}$ can be continuously, continually or intermittently detected (step 120) and evaluated (step 122), and the PMD 34 can be adjusted (steps 124, 126) as often as necessary to maintain the zonal pressures $P_z$ at a desired level. When the closure member 74 is already disposed in the intended location, e.g., where the closure member 74 is in the closed position and where repeating steps 120, 122 determines that the zonal pressure $P_z$ is still at or above the predetermined threshold, the procedure 100 can proceed back to step 120 without instructing the pump to operate, i.e., steps 124, 126 can be skipped if no change to the location of the closure member 74 is required.

In some embodiments, the conveyance of the gravel packing fluid through the interior passage 56 can be discontinued, e.g., when gravel packing operations for a particular zone 14 are complete. The procedure 100 can then proceed to optional step 128 where the shear joint 36 is released. The shear joint 36 can be released by operating the pump 44 to provide hydraulic fluid "H" thereto.

In some embodiments, the procedure 100 can proceed to step 130 where another down-hole flow control service tool can be actuated. Thus, in one or more embodiments, (see, e.g., service tool 402 illustrated in FIG. 10A) a circulating valve 32 can be actuated, to thereby permit or restrict fluid flow therethrough. For example, the circulating valve 32 can be actuated to redirect flow in a crossover gravel packing operation. Thereafter, the procedure 100 can proceed to step 132 where the screen system 16 is operated to permit inflow of fluids from one or more of the annular spaces 22*a*, 22*b* into the interior passage 56. The procedure 100 can proceed back to step 120 to detect zonal pressure $P_z$, or to decision 110 to check for errors at any time during the procedure.

Figure 6:
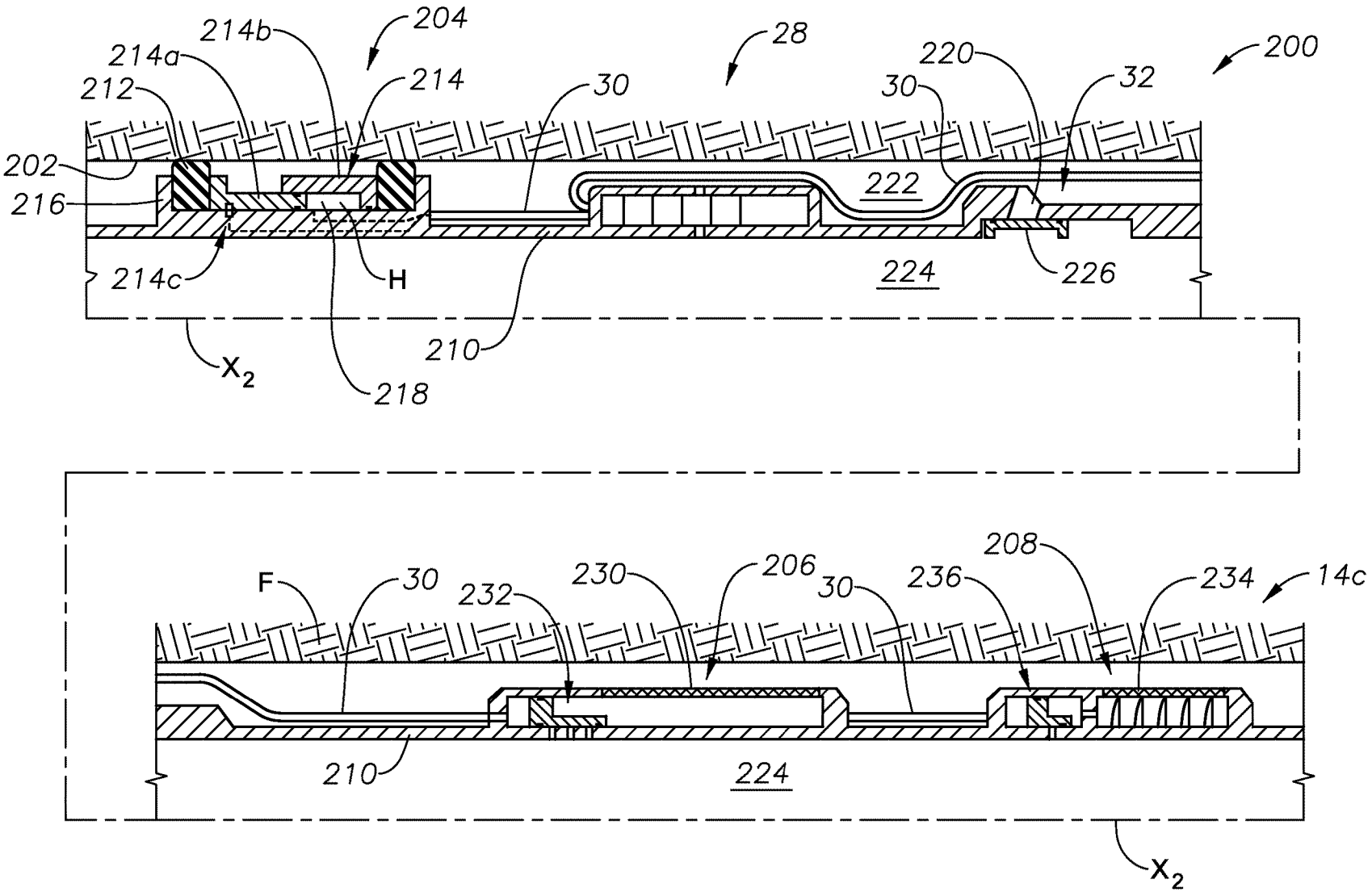
FIG. 6 is a partially cross-sectional schematic view of an open-hole well completion system including the control module of FIG. 2A, an isolation member, a circulating valve, an inflow control valve ("ICV") and an inflow control device ("ICD") in accordance with example embodiments of the present disclosure.

Referring to FIG. 6, a well completion system 200 illustrates other example embodiments in accordance with the present disclosure. Well completion system 200 is illustrated as deployed in an un-cased or open-hole wellbore, although one skilled in the art would recognize that aspects of well completion system 200 can be practiced in a cased well system as well. In well completion system 200, a wellbore 202 extends through geologic formation "F" along a longitudinal axis $X_2$. Although only one zone 14*c* is illustrated in FIG. 6, one skilled in the art would recognize that additional zones, e.g., zone 14*d* (FIG. 7), can be established in well completion system 200, and similarly, aspects of well completion system 200 can be practiced in a single-zone well system.

Well completion system 200 generally includes a control module 28, and flow control tools such as an isolation system 204, a circulating valve 32, an inflow control valve or ICV 206, and an inflow control device 208 each interconnected with one another in a tubular string 210. The control module 28 in well completion system 200 is operably coupled to the isolation system 204, the ICV 206 and the ICD 208 by control lines 30. Hydraulic pressure, electrical power, data and/or other signals can be transmitted through the control lines 30 to permit the control module 28 to operate the various flow control tools of well completion system 200 to which the control module 28 is coupled.

The isolation system 204 includes at least one sealing member 212. In one or more embodiments, sealing member 212 is a generally ring-shaped structure. The sealing member 212 can be constructed of an elastomeric material that can be expanded radially outwardly to engage a wall of the wellbore 202, e.g., a wall of the geologic formation "F," and form a seal therewith. The isolation system 204 may further include a setting mechanism 214 for radially expanding the sealing member 212. In one or more embodiments, the setting mechanism 214 includes two mandrels 214*a*, 214*b* and is operable to axially compress the sealing member 212 against an annular wall 216, thereby radially expanding the sealing member 212. The force to axially compress the sealing member 212 is provided by hydraulic pressure transmitted to a fluid chamber 218 defined between the two mandrels 214*a*, 214*b*, which axially separates the mandrels 214*a*, 214*b*. As described above, control module 28 is operable to selectively provide hydraulic fluid "H" to the setting mechanism 214 through control line 30 in a predetermined sequence of pressure increases and pressure holds. In one or more embodiments, the setting mechanism 214 includes a feedback device 214*c*, which is operably coupled to the control module 28 through control line 30. The feedback device 214*c* is a proximity sensor associated with the mandrel 214*a* that provides a signal to the control module 28 when the mandrel 214*a* reaches a longitudinal position that indicates the isolation system 204 has been properly set. In other embodiments, other types of feedback devices (not shown) can be associated with the setting mechanism 214 for providing an indication that the isolation system 201 is properly set. For example, pressure sensors, flow rate sensors or other mechanisms that detect and/or react to an environmental characteristic can be provided.

In some embodiments, the setting mechanism 214 can rotate, inflate or otherwise mechanically manipulate the sealing member 212 to radially expand the sealing member 28. One suitable isolation system 20 is the WIZARD® III packer marketed by Halliburton Energy Services, Inc., although the use other types of packers is also contemplated.

The circulating valve 32 includes a radial port 220 for providing fluid communication between an annular space 222 defined between the tubular string and the geologic formation "F" and an interior passage 224 extending through the tubular string 210. The circulating valve 32 also includes a sleeve or sleeve member 226 disposed therein, which can be axially shifted between a closed position (as illustrated in FIG. 6) and an open position (not shown). When the sleeve member 226 is in the closed position, fluid flow through the radial port 220 is obstructed by the sleeve member 226, and when the sleeve member 226 is in the open position, fluid flow through the radial port 220 is permitted. The sleeve member 226 of the circulating valve 32 can be axially shifted by physically engaging a service tool (see, e.g., service tool 402 illustrated in FIG. 10A) moving through the wellbore 202.

The ICV 206 is generally disposed within an ICV screen or sand screen system 230, and includes a choke member 232. The choke member 232 is actively controllable by the control module 28 to partially or completely choke inflow from the screen system 230 into the interior passage 224, or outflow from the interior passage 224. The ICV 206 is described in greater detail below with reference to FIG. 7. The ICD 208 is a generally passive unit configured to increase resistance to flow into the interior passage 224. A tortuous path can be defined though the ICD 208 to increase resistance to fluid flow therethrough. An ICD screen or sand screen system 234 is provided at an entrance to the tortuous flow path, and an on-off valve 236 is provided to selectively interrupt or permit flow through the ICD 208. The ICD 208 is described in greater detail below with reference to FIG. 8.

Figure 7:
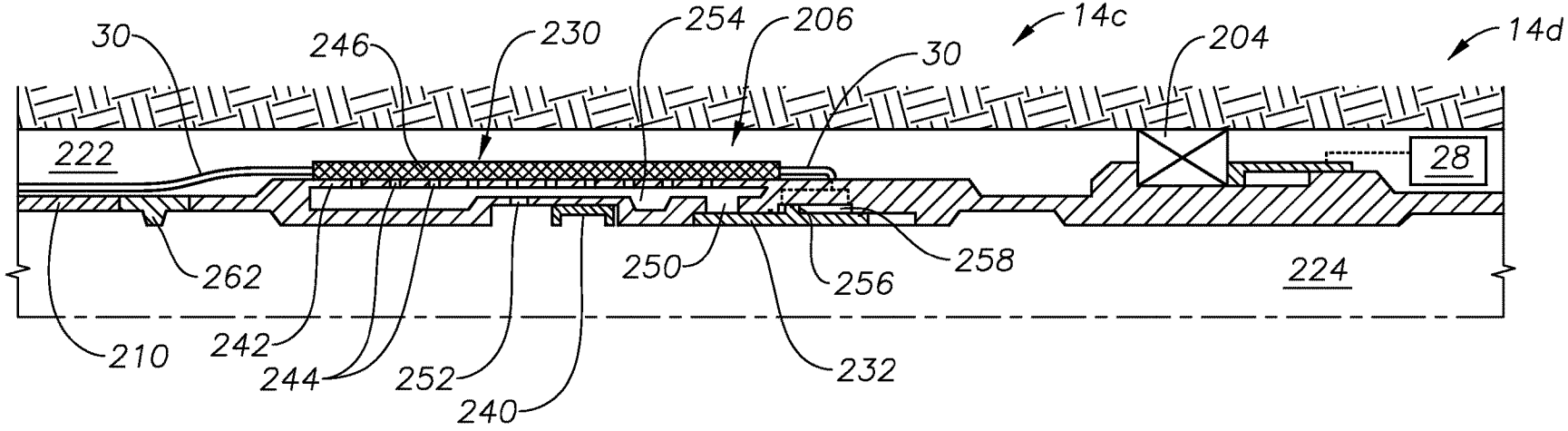
FIG. 7 is a schematic view of a sand screen system including a frac sleeve and the ICV of FIG. 6 integrated therein.

Referring to FIG. 7, the choke member 232 of ICV 206 and a frac sleeve 240 are disposed within sand screen system 230. The sand screen system 230 includes a base pipe 242 extending radially about the ICV 206 and frac sleeve 240 disposed therein. The base pipe 242 has perforations 244 formed therein, and a wire wrap screen 246 disposed radially about the base pipe 242. In some embodiments (not shown), a sand screen system can be provided that includes a dual base pipe, a single base pipe with a drainage layer and shroud, although the disclosure is not limited to a particular screen system.

An ICV opening 250 and frac port 252 selectively provide fluid communication between the screen system 230 and interior passage 224 through a common fluid cavity 254. Both the ICV opening 250 and the frac port 252 are disposed radially and axially within the sand screen system 230 such that fluids communicated between annular space 222 and the ICV opening 250 and/or the frac port 252 passes through the sand screen system 230.

The choke member 232 of the ICV 206 is axially movable to obstruct all or any portion of ICV opening 250, and thereby regulate flow therethrough. The choke member 232 includes a piston 256 extending into a fluid chamber 258. The fluid chamber 258 is in fluid communication with control module 28 (FIG. 6) through control line 30, and thus, the choke member 232 is axially movable by the control module 28. The piston 256 of choke member 232 can comprise a "dual-action" piston, and thus the piston the choke member 232 can operate in the same manner that closure member 74 of PMD 34 operates as described above with reference to FIG. 3.

The frac sleeve 240 is depicted in an open position wherein fluid flow through the frac port 252 is substantially unobstructed. The frac sleeve 240 can be axially shifted to a closed position by a physically engaging dropped ball (not shown), a service tool (see, e.g., service tool 402 illustrated in FIG. 10A), or by other methods recognized in the art.

Also illustrated in FIG. 7, a position indicator 262 is provided in the tubular string 210. In some embodiments, the position indicator 262 is recognizable by a service tool or other mechanism deployed through the interior passage 224 such that a relative position of the service tool or other mechanism with respect to the position indicator 262 is determinable. An isolation system 204 is disposed down-hole of ICV 206 can be operably coupled to an additional control module 28 disposed in a zone 14*d* down-hole of zone 14*c*. In some embodiments, zone 14*d* can include each of the down-hole components provided in zone 14*c*.

Figure 8:
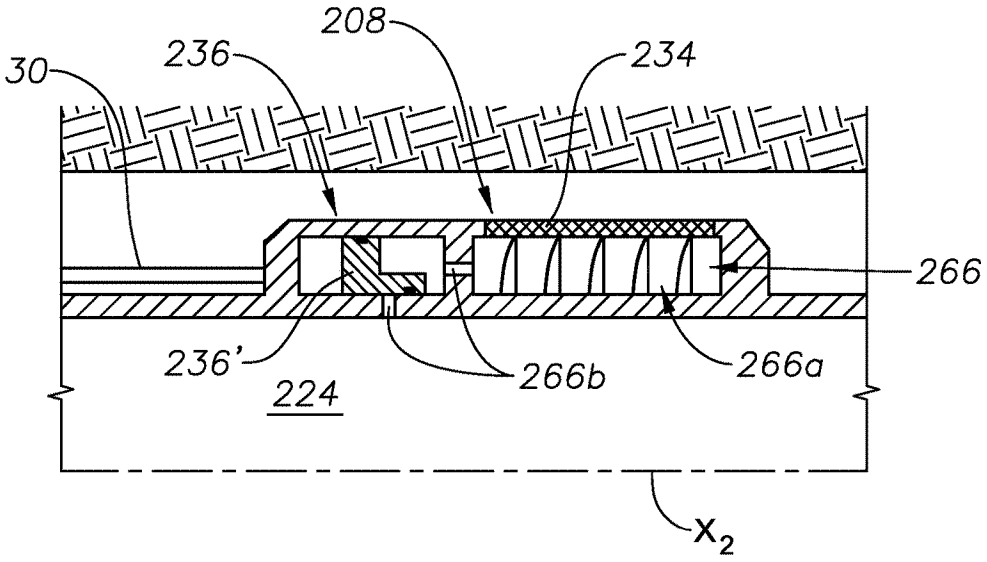
FIG. 8 is a schematic view of the ICD of FIG. 6.

Referring to FIG. 8, ICD 208 is disposed within the sand screen system 234. Sand screen system 234 can include wire-wrapped screens, or any other configurations discussed above with reference to sand screen system 230 (FIG. 7). A tortuous path 266 is defined within ICD 208 between the screen system 234 and the interior passage 224. The tortuous path 266 includes a fluid passageway 266*a* arranged in a spiral configuration about longitudinal axis $X_2$. In some embodiments, a tortuous path can include nozzles, tubes, orifices, helical paths, fluid diodes and/or other mechanisms recognized in the art to create a pressure drop and slow the flow of fluids though the ICD 208. A fluid passageway 266*b* forms part of the tortuous path 266 and extends between the fluid passageway 266*a* and the interior passage 224. The on-off valve 236 is disposed within the fluid passageway 266*b* and is selectively operable to obstruct or permit flow therethrough. The on-off valve 236 can include activation mechanisms 236' such as gates, butterfly flappers, ball members, globe members or members that can be hydraulically urged into a valve seat (not shown) or another closed arrangement to obstruct flow through the fluid passageway 266*b* and/or hydraulically urged away from the valve seat of another open arrangement to permit fluid flow through the passageway 266*b*. A control line 30 extends to the on-off valve 236 from control module 28 (FIG. 6) such that the activation mechanism 236' of the on-off valve 236 can be controlled by the control module 28.

Figure 9:
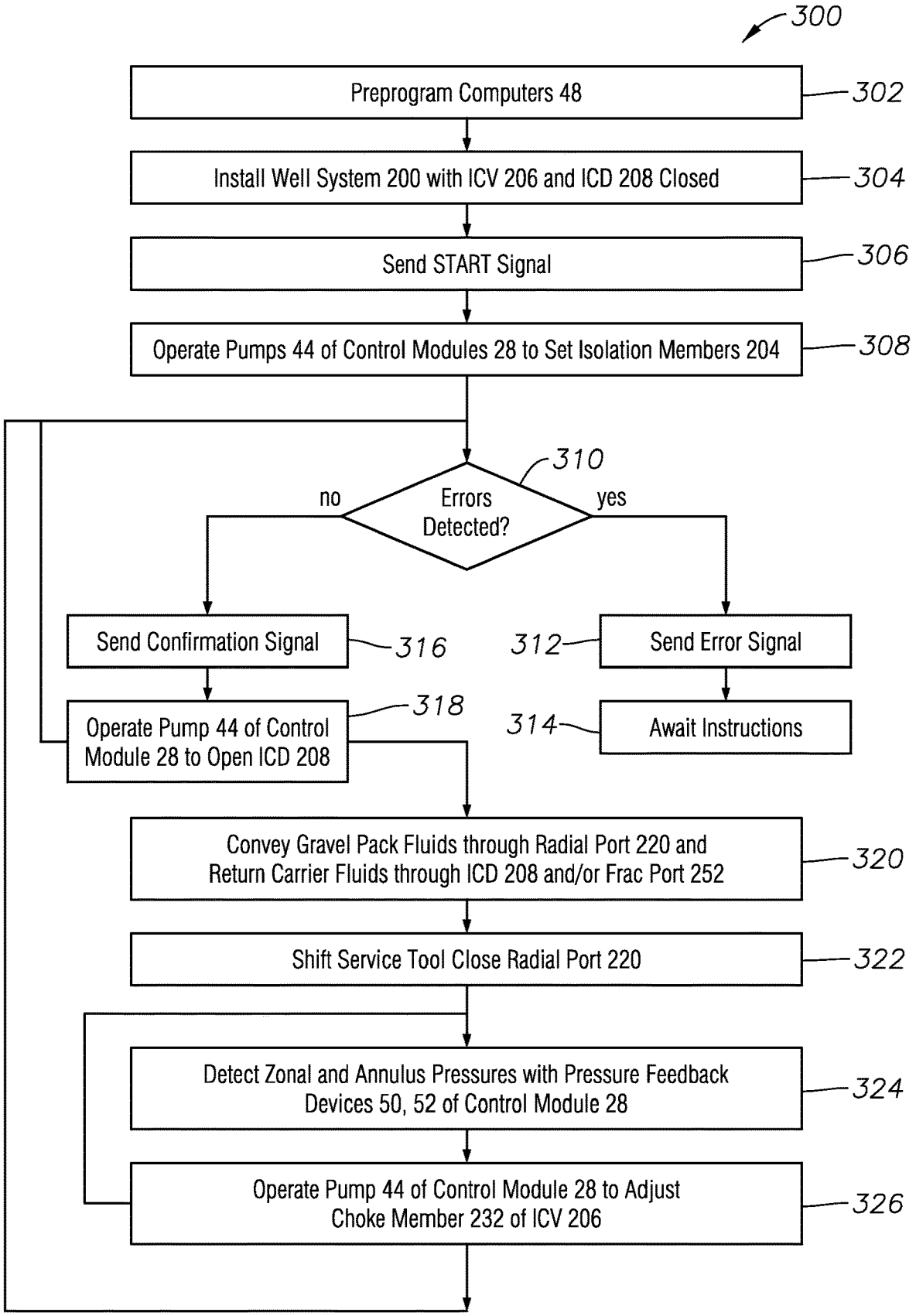
FIG. 9 is a flowchart illustrating a method of operating the well completion system of FIG. 6 in accordance with example embodiments of the present disclosure.

Referring to FIG. 9 and with continued reference to FIGS. 2A and 6-8, operational procedure 300 illustrates example embodiments of methods for controlling flow in wellbore 12 by well completion system 200. Although operational procedure 300 is described below in the context of a gravel packing operation, use of well completion system 200 is also envisioned for use in hydraulic fracturing, and other flow control operations as well. Initially, at step 302, parameters associated with the control of fluid flow by well completion system 200 are determined. These parameters may include identifying one or more zones in the wellbore 202 for production of hydrocarbon, identifying the vertical depths or longitudinal positions for each zone 14*c*, 14*d*, identifying the formation pressures associated with each zone 14*c*, 14*d*, identifying differential pressures between points in well completion system 200 and identifying conditions for fluid flow through each zone 14*c*, 14*d*. As part of step 302, a controller 48 in each control module 28 can be preprogrammed based on these parameters, by installing instructions and data onto the respective computer readable medium 48*b*. The instructions can include instructions for executing any of the steps of the operational procedure 300, as described below, including, e.g., instructions for operating the pump 44 of the control module 28 to actuate flow control tools of the well completion system 200 (see, e.g., steps 308, 318 and 326). The data installed on the computer readable mediums 48*b* can include a predetermined threshold pressure at which each of the zones 14*c*, 14*d* is to be maintained, or a target differential pressure between the interior passage 224 and a particular zone 14*c*, 14*d*. Each controller 48 can be individually preprogrammed with a different threshold pressure such that each zone 14*c*, 14*d* can be maintained at an individual pressure. Thus, in one or more embodiments, it will be appreciated that desired vertical depth or longitudinal position for each zone 14 is determined and then the formation pressure adjacent the zones 14 is identified. The predetermined threshold pressure is then selected for each zone to ensure that the individual zonal pressure $P_z$ is balanced or overbalanced in order to prevent formation fluids from migrating into the individual zone 14.

Next, the well completion system 200 can be installed in the wellbore 202 (step 304) by running it into the wellbore 202 until the equipment is positioned at a desired vertical depth or longitudinal position. In some embodiments, the well completion system 200 can be installed with the ICV 206 and ICD 208 in their respective closed configurations, e.g., with the choke member 232 positioned to fully obstruct the ICV opening 250, and with the on-off valve 236 positioned to obstruct the fluid passageway 266*b*. Maintaining the ICV 206 and ICD 208 in their closed configurations helps to prevent plugging or clogging the screens systems 230, 234 and the ICV 206 and ICD 208 themselves.

At step 306, a signal, such as a "START" signal, may be generated to activate various tools of well completion system 200 once installed. In one or more embodiments, the signal is transmitted to communication unit 60 in order to initiate operation of the well completion system 200 once installed. In one or more embodiments, an operator at the surface can send the "START" signal to the control modules 28. In other embodiments, the "START" signal may be automatically generated (either locally or transmitted from the surface) when certain conditions related to the well completion system 200 exist. For example, the well completion system 200 may reach the desired vertical depth, thereby causing a latch (not shown) to be engaged and triggering the transmission of a "START" signal or a sensor may identify or verify the presence of the well completion system 200 at a particular location and trigger the transmission of a "START" signal. In any event, the "START" signal may be locally generated or transmitted from within the wellbore 202.

In any event, once conditions are met for continuing with operational procedure 300, the isolation system(s) 20 are actuated at step 308. Actuation of isolation system 20 may be initiated by the control modules 28 or otherwise. In one or more embodiments, control module 28 can execute instructions for setting the isolation systems 20. At step 308, pumps 44 are operated to cause sealing member 212 to expand radially outward to engage the wellbore wall or casing wall. In one or more embodiments, pumps 44 provide hydraulic fluid H from fluid chamber 218 to actuate setting mechanism 214 as described herein. In one or more embodiments, at least two sealing members 212 are expanded as described, namely an upper sealing member and a lower sealing member, in order to define an annular zone 14 there between.

In an optional step 310, with sealing members 212 set, the control module 28 can then check for errors. For example, the control module 28 can query feedback device 214*c* for a signal indicating the mandrel 214*a* has reached a predetermined location, which indicates the isolation system 204 is properly set. Where the signal cannot be detected by the control module 28, an error can be recorded by the control module. Additionally, in some embodiments, an error can be recorded if the pressure feedback devices 50, 52 indicate that the zonal pressure $P_z$ and/or the inner annulus pressure annulus pressure $P_{ia}$ falls outside a predetermined pressure range.

If an error is detected, then at step 312, an error signal may be generated. In one or more embodiments, the error signal may be transmitted to the operator at the surface, while in other embodiments, the error signal may just be transmitted locally to control module 28. In some embodiments, depending on the nature of the error detected, the control module 28 may be programmed to await further instructions (step 314) whether from the operator at the surface, or from a control module 28 disposed in another zone 14*c*, 14*d* or from other components of the well completion system 200. If no errors are detected at decision 310, at step 316, the control module 28 may transmit a confirmation signal whether to the operator at the surface, or to a control module 28 disposed in another zone 14*c*, 14*d* or to other components of the well completion system 200. Alternatively, one or more of steps 310, 312 and 316 can be eliminated and operational procedure 300 can just progress to step 318. In some embodiments, steps 306, 308, 310, 312 and 316 are substantially similar to steps 106, 108, 110, 112 and 116 described above with reference to FIG. 5.

In step 318, pump 44 is operated to actuate the on-off valve 236 to open the ICD 208 and permit fluid flow through the fluid passage 266*b*. In some embodiments, operation of pump 44 is responsive to instructions from controller 48. Fluids can then be passed through the ICD 208. In some embodiments, gravel pack fluids can be conveyed downhole through interior passage 224, then into annular space 222 through radial port 220 (step 320). Gravel can be deposited from the gravel pack fluids into the annular space 222, and carrier fluids can be returned through frac port 252 and/or ICD 208 (step 320). When sufficient gravel has been deposited, a service tool (not shown) can be shifted to move frac sleeve 240 and sleeve member 226, and thereby close frac port 252 and radial port 220 (step 322), respectively. With the frac port 252 and the radial port 220 closed, production from the zone 14*c* can be initiated.

At step 324, zonal and inner annulus pressures $P_z$, $P_{ia}$ are monitored with pressure feedback devices 50, 52. Based on these pressures $P_z$, $P_{ia}$, an appropriate position for choke member 232 of ICV 206, e.g., an appropriate position to achieve the target differential pressure identified in step 302, are determined. In some embodiments, controller 48 may be used to monitor the wellbore pressures in step 324 and make determinations about ICV 206 based on the identified operational parameters installed on the controller 48 in step 302. In any event, a pump 44 of the control module 28 is operated to adjust the choke member 232 to the appropriate position (step 326). The procedure 300 can continue to repeat step 324 and 326 so that the zonal and inner annulus pressures $P_z$, $P_{ia}$ can continue to be monitored, and the ICV 206 can be automatically adjusted by the control module 28. The procedure 300 can also return to decision 310 at any time to check for errors. Again, in some embodiments, controller 48 may be utilized to control operation of pump 44 for this purpose.

Figure 10A:
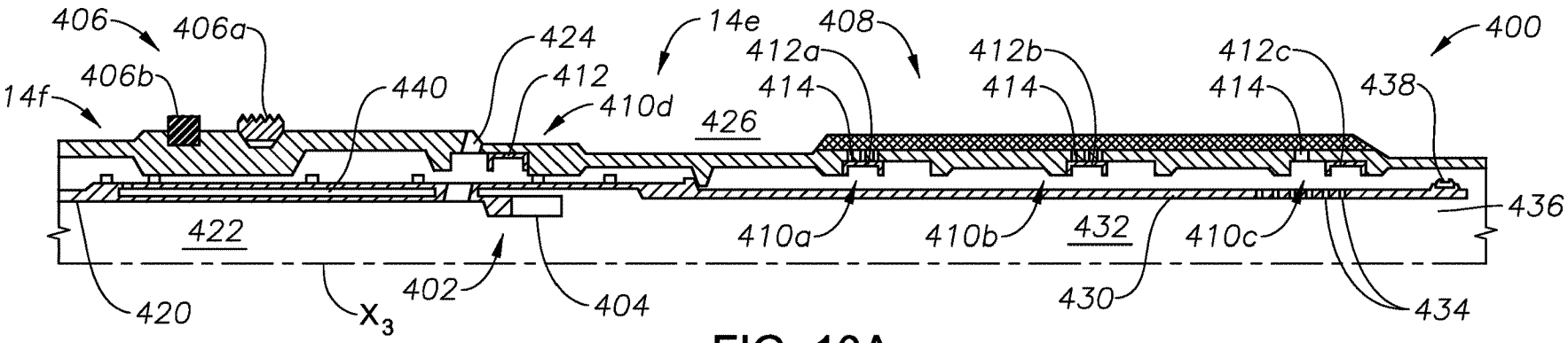
FIG. 10A is a partially cross-sectional schematic view of well completion system including a service tool in accordance example embodiments of the present disclosure.

Referring FIG. 10A, well completion system 400 illustrates other example embodiments of the present disclosure. The well completion system 400 extends along longitudinal axis $X_3$ and includes a service tool 402 with a multi-position valve 404 thereon. In some embodiments, the service tool 402 can be employed to facilitate gravel packing and hydraulic fracturing operations as described below. Although only two zones 14*e* and 14*f* are illustrated in FIG. 10A, one skilled in the art would recognize that additional zones can be established in well completion system 400, and similarly, aspects of well completion system 400 can be practiced in a single-zone well system.

The well completion system 400 includes an isolation system 406 disposed at a radially outer location thereof. In one or more embodiments, the isolation system 406 includes a packer slip 406*a* and an elastomeric sealing member 406*b*. The packer slip 406*a* is operable to dig into the metal of a well casing (not shown), and thereby grip the well casing. The elastomeric sealing member 406*b* is operable to establish an annular seal with the casing. In some embodiments, well completion system 400 can be employed in uncased or open-hole environments as well.

The well completion system 400 also includes a screen system 408 disposed at a radially outer location of the well completion system 400. In one or more embodiments, a plurality of sleeve valves 410*a*, 410*b*, 410*c* may be disposed within the screen system 408, and may each include a sleeve member 412 that is selectively movable to permit and obstruct fluid flow through a respective radial opening 414. The respective sleeve member 412 of the sleeve valves 410*a*, 410*b* are illustrated in a closed position wherein fluid flow through the respective radial opening 414 is obstructed. The sleeve member 412 of the sleeve valve 410*c* is illustrated in an open position wherein fluid flow through the respective radial opening 414 is permitted.

A tubular string 420 of the well completion system 400 defines an interior passage 422 therein. A radial port 424 (or crossover port) of a circulating valve 410*d* provides fluid communication between the interior passage 422 and an annular space 426 (or annular zone) on an exterior of the well completion system 400. The circulating valve 410*d* is provided with a sleeve member 412 that is selectively movable to permit or obstruct fluid flow through the radial port 424.

The service tool 402 includes a wash pipe 430 extending generally between the screen system 408 and the multi-position valve 404. The wash pipe 430 defines an interior passage 432 extending therethrough and radial perforations 434 therein that provide fluid communication between the screen system 408 and the interior passage 432. In some embodiments, the washpipe can include a lower opening 436 defined therein, through which fluids can be expelled from the washpipe 430. A mechanical catch 438 is provided on a radially outer surface of the wash pipe 430. The mechanical catch 438 is operable to engage the sleeve members 412 to move the sleeve members 412 between the open and closed positions as the wash pipe 430 is moved therepast.

As described in greater detail below, the multi-position valve 404 is selectively operable to permit or obstruct fluid flow between the interior passage 422 of the tubular string 420 and the interior passage 432 of the wash pipe 430. The multi-position valve 404 is also selectively operable to permit or restrict fluid flow between the interior passage 432 of the wash pipe 430 and a return passage 440 extending on the exterior of the tubular string 420.

Figure 10B:
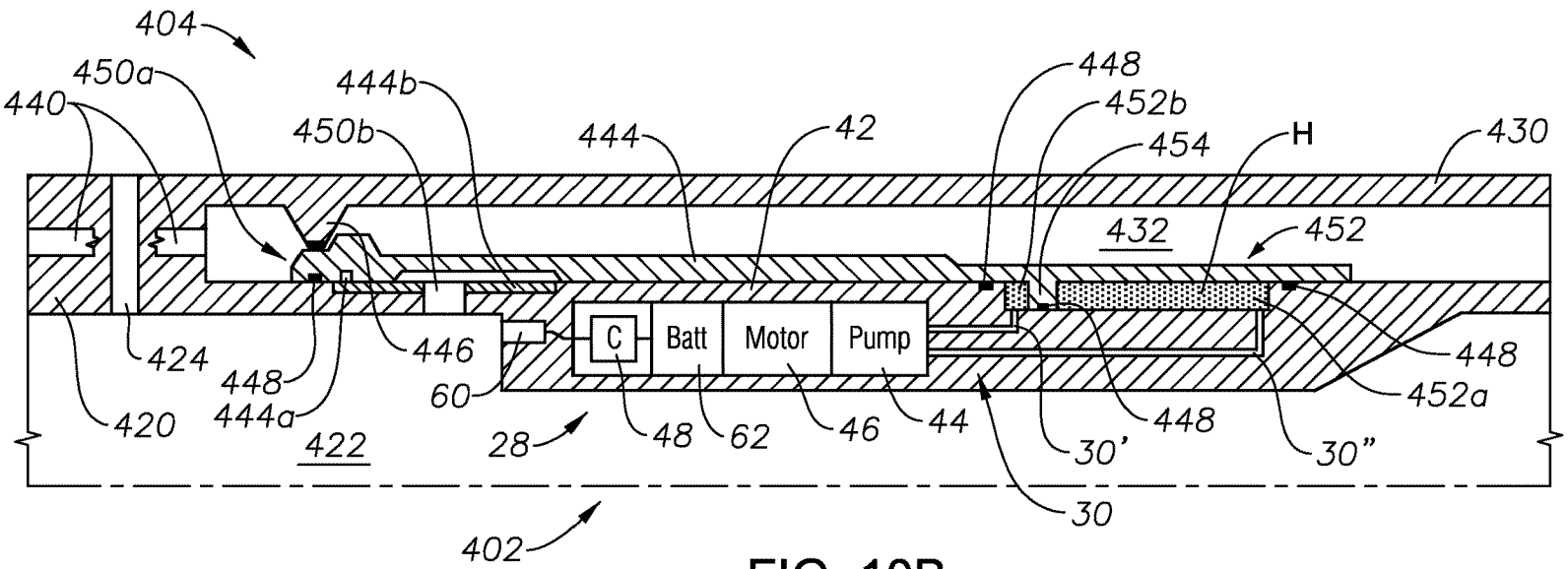
FIG. 10B is a partially cross-sectional schematic view of the service tool of FIG. 10A including the control module of FIG. 2A and a multi-position valve in accordance with example embodiments of the present disclosure.
Figure 11A:
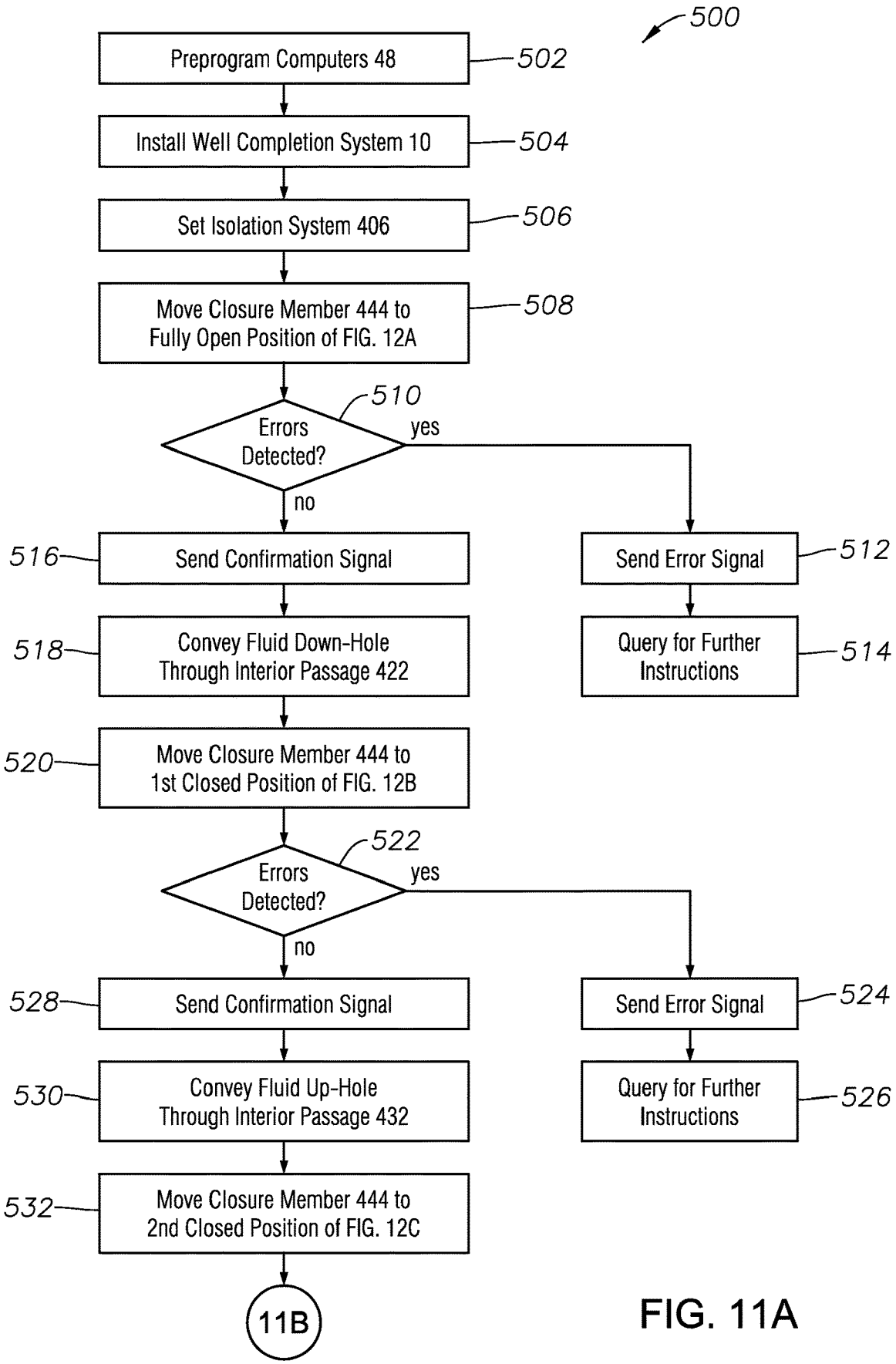
FIGS. 11A and 11B are a flowchart illustrating a method of performing a gravel pack operation utilizing the well completion system of FIG. 10A in accordance with example embodiments of the present disclosure.
Figure 11B:
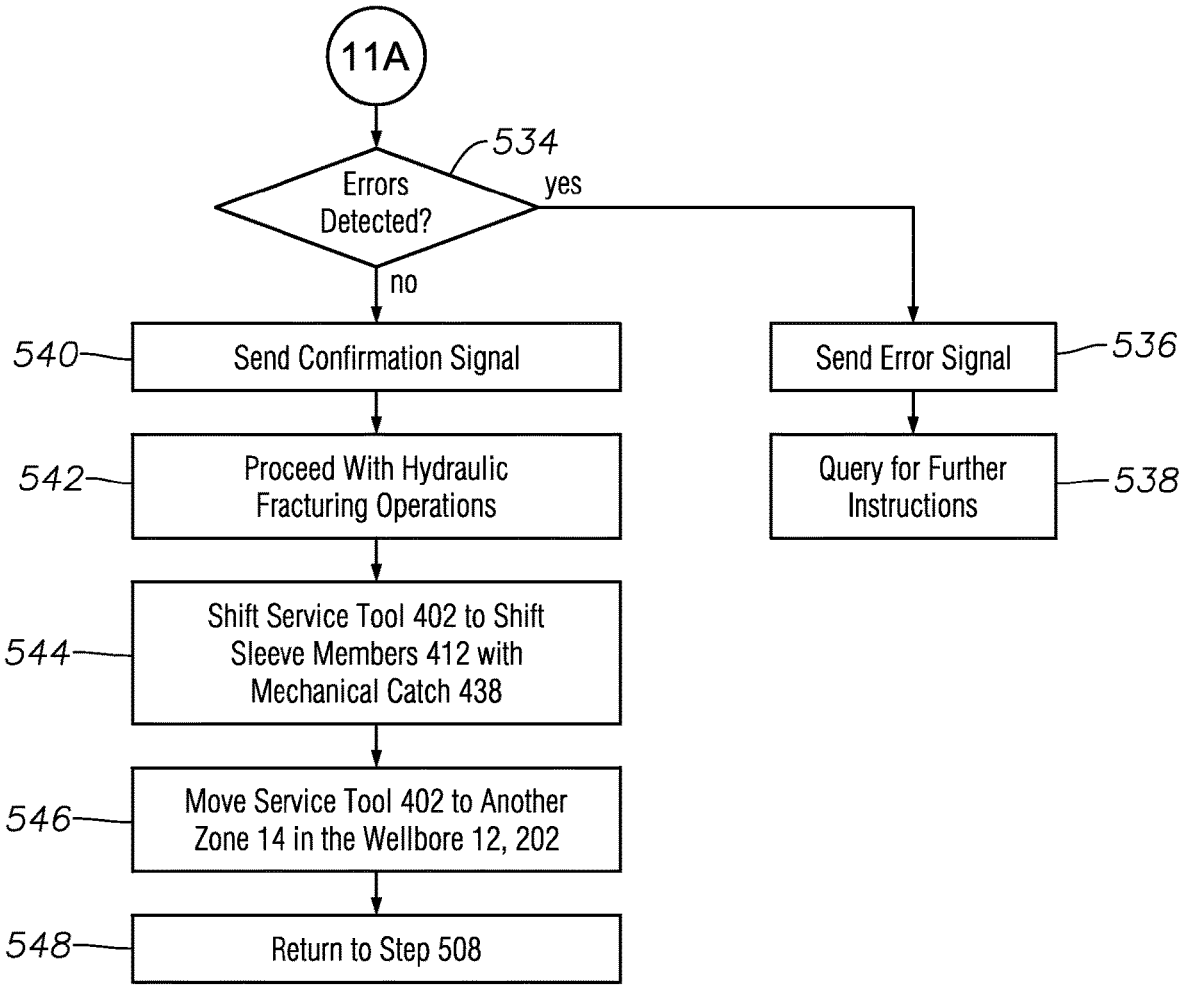

Referring to FIG. 10B, the multi-position valve 404 includes a closure member 444 disposed within the interior passage 432 of the wash pipe 430, and located down-hole of the radial port 424. The closure member 444 is illustrated in a fully closed position wherein fluid flow is obstructed between the interior passage 432 of the wash pipe 430 and both the interior passage 422 of the tubular string 420 and the return passage 440. The closure member 444 engages molded sealing member 446 protruding into the interior passage 432 to prohibit fluid flow through a return port 450*a* into the return passage 440. The closure member 444 is also positioned to obstruct fluid flow through a tubing port 450*b* extending between the tubular string 420 and the wash pipe 430. Sealing members 448 such as o-rings are provided about the closure member 444 to prevent fluid flow therepast.

In one or more embodiments a feedback device 444*a* and 444*b* can be associated with the closure member 444 to indicate a position of the closure member. In some embodiments, the feedback device 444*a* is an encoder having a head 444*a* (carried by the closure member 444) paired with a scale 444*b* (stationary on the multi-position valve 404), which together are operable to provide a signal to computer 48 that is indicative of a location of the head 444*a* along the scale 444*b*. In other embodiments (not shown), the feedback device 444*a*, 444*b* can include proximity sensors, pressure sensors or other mechanisms for assessing the location of the closure member 444.

The service tool 402 also includes a control module 28 operable to move the closure member 444 in axial directions. As described above with reference to FIG. 2A, the control module 28 includes pump 44, motor 46, a controller 48 and power source 62. The control module 28 is in fluid communication with a fluid chamber 452 through dual control line 30. The fluid chamber 452 is axially divided into two sections 452*a*, 452*b* by a piston 454 extending from the closure member 444. Each of the two sections 452*a*, 452*b* of the fluid chamber 452 is fluidly coupled to a respective passage 30', 30" of the dual control line 30 such that hydraulic fluid "H" can be selectively provided to one of the two sections 452*a*, 452*b* and withdrawn from the other of the two sections 452*a*, 452*b* by the control module 28. The closure member 444 can thus be operated in the same manner that closure member 74 of PMD 34 operates as described above with reference to FIG. 3.

The reservoir 64 (FIG. 2A) for hydraulic fluid "H" is not illustrated within the control unit 28 in FIG. 10B. Since moving the closure member 444 can be achieved by transferring hydraulic fluid "H" from one section 452*a*, 452*b* of the fluid chamber 452 to the other section 452*a*, 452*b* within a closed fluid system, an additional supply of hydraulic fluid "H" is not necessary in some embodiments. In some embodiments, e.g., where the control module 28 is operatively coupled to the isolation member 406 to set the packer slip 406*a* and/or the sealing member 406*b*, a supply of hydraulic fluid "H" can be provided within a reservoir 64 (FIG. 2B) disposed within the housing 42 of the control module 28.

The communication unit 60 of control module 28 is illustrated coupled to the tubular string 420 at a location outside the housing 42. In some embodiments, the communication unit 60 can be disposed within the housing 42 (see FIG. 2A) or at any location for receiving and transmitting instructions, error messages, or other signals discussed above.

Referring to FIGS. 11A through 12C and with continued reference to FIGS. 10A and 10B, operational procedure 500 illustrates example embodiments of a method for controlling flow in well completion system 400. Initially, at step 502 parameters associated with the control of fluid flow by well completion system 400 are determined. These parameters may include identifying one or more zones 14*e* in a wellbore, e.g., wellbore 12 (FIG. 1) or wellbore 202 (FIG. 6) for production of hydrocarbon, identifying the vertical depths or longitudinal positions for the one or more zones 14*e*, identifying the formation pressures associated with the one or more zones 14*e*, identifying differential pressures between points in well completion system 400 and identifying conditions for fluid flow through the one or more zones 14*e*.

As part of step 502, one or more controllers 48 in one or more control modules 28 can be preprogrammed based on these parameters. In some embodiments, the number of control modules 28 corresponds to the number of zones 14*e* identified. The one or more controllers 48 can be preprogrammed by installing instructions and data onto the respective computer readable medium 48*b*. The instructions can include instructions for executing any of the steps of the operational procedure 500, as described below, including, e.g., instructions for operating the pump 44 of the control module 28 to actuate flow control tools of the well completion system 400 (see, e.g., steps 508, 520 and 532). The data installed on the computer readable mediums 48*b* can include a predetermined threshold pressure at which each of the zones 14*e* is to be maintained, or a target differential pressure between the interior passage 422 and a particular zone 14*e*. Thus, in one or more embodiments, it will be appreciated that desired vertical depth or longitudinal position for each zone 14*e* is determined and then the formation pressure adjacent the zones 14 is identified. The predetermined threshold pressure is then selected for each zone to ensure that the individual zonal pressure $P_z$ is balanced or overbalanced in order to prevent formation fluids from migrating into the individual zone 14.

The data installed can include predetermined thresholds for detectable characteristics indicative of errors. For example, a threshold pressure indicative of an excessive overbalance condition, and above which an error is to be recorded, can be installed onto the computer readable medium 48*b*. Additionally, expected positions for the closure member 444 at various stages of the operational procedure 500 can be preprogrammed onto the computer readable medium 48*b*. An error can be detected when the closure member 444 is determined to be at a location other than the expected positions. The instructions installed can include instructions for executing any of the steps of the operational procedure 500, as described below, including, e.g., instructions contingent on the detection of various error states.

Next, in step 504, the well completion system 400 can be installed in a wellbore (see, e.g., wellbores 12 (FIG. 1) or 202 (FIG. 6) by running the well completion system 400 into the wellbore 12, 202 until the equipment is positioned at the desired vertical depth or longitudinal position. At step 506, the isolation system 406 can be set in the wellbore 12, 202. In some embodiments, the isolation system 406 can be set by operating the pump 44 of the control module 28 to provide hydraulic fluid "H" thereto (see, e.g., steps 108 and 308 of operational procedures 100, 300 respectively, described above), or by other methods recognized in the art. In some embodiments, additional isolation members (not shown) can be spaced apart and set in the wellbore 12, 202 to establish additional annular zones 14 therein.

Figure 12A:
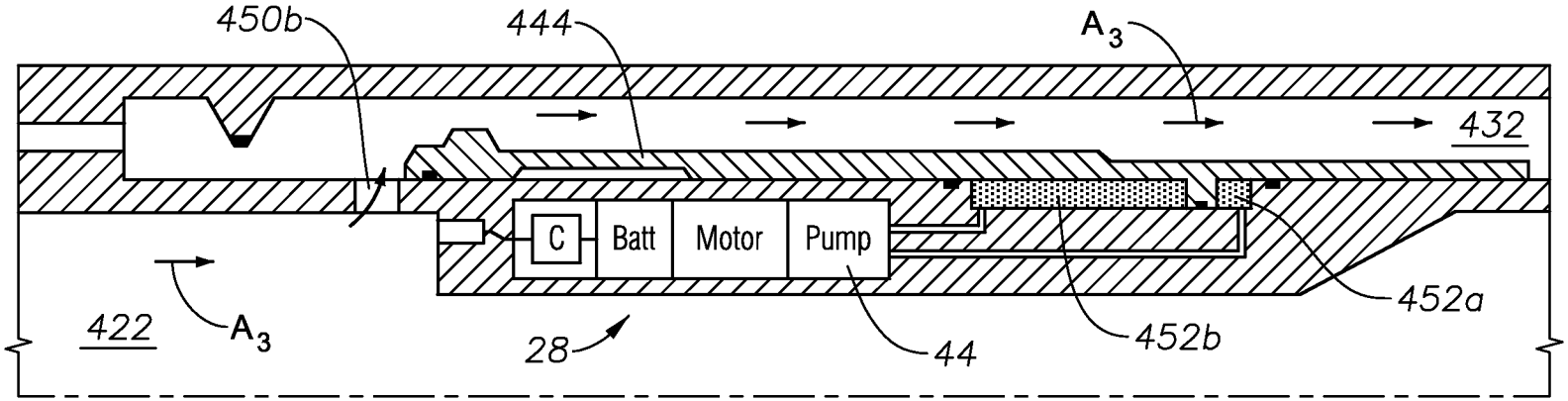
FIGS. 12A through 12C are schematic views of the service tool of FIG. 10A illustrating various fluid flow paths through the service tool with a closure member of the multi-position valve arranged in each of three positions.

At step 508, the closure member 444 of the multi-position valve 404 can be activated to move the closure member 444 to a fully open position as illustrated in FIG. 12A. In some embodiments, a signal such as a "START" signal can be generated when it is determined that conditions are met for moving the closure member 444 to the fully open position. In some embodiments, the "START" signal may be an electronic signal automatically generated by the processor 48*a* (FIG. 2A) of the controller 48 when certain conditions related to the well completion system 400 exist. For example, the controller 48 may generate the "START" signal when a sensor, such as the position indicator 262, identifies or verifies the presence of portions of the well completion system 400 at a particular location. In other embodiments, the "START" signal can be an acoustic or other telemetry signal transmitted from the surface. In any event, in response to the "START" signal, a local activation signal can be generated within the wellbore 12, 202 to move the closure member 444. In some embodiments, the control module 28 can initiate a series of instructions that were installed in the controller 48 in step 502 to generate the local activation signal by pumping hydraulic fluid "H" from a reservoir within the wellbore 12, 202 to the closure member 444. For example, these instructions can include, e.g., instructions to operate the pump 44 to withdraw hydraulic fluid "H" from section 452*a* of the fluid chamber 452, and simultaneously provide hydraulic fluid "H" to section 452*b* of the fluid chamber 452. Executing these instructions can result in a change in volume of both sections 452*a*, 452*b*, thereby urging the piston 454 in the direction of section 452*a*. The closure member 444 can thereby be urged toward the fully open position. With the closure member 444 in the fully open position, fluid communication can be established between the interior passage 422 of the tubular string 420 and the interior passage 432 of the washpipe 430, through tubing port 450*b*.

In an optional decision step 510, the control module 28 can then check for errors. For example, the controller 48 can query the feedback device 444*a*, 444*b* for a location of the closure member 444. The controller 48 can compare a position returned from the feedback device 444*a*, 444*b* with an expected position corresponding to the fully open position that was programmed onto the controller 48 in step 502. An error condition can be detected when the position returned from the feedback device 444*a*, 444*b* is not the expected position.

If an error condition is detected at step 510, an error signal can be generated at step 512. In one or more embodiments, the error signal may be transmitted to the operator at the surface, while in other embodiments, the error signal may be transmitted only locally, e.g., within the control module 28 and/or the wellbore 12, 202. In some embodiments, the procedure 500 can then proceed to step 514 where the controller 48 is programmed to query various locations for instructions for responding to the specific error encountered. For example, the controller 48 may query the computer readable medium 48*b* (FIG. 2B) for instructions, and/or the communication unit 60 for instructions received from the operator at the surface. If no errors are detected at decision 510, a confirmation signal may be sent in step 516, whether to the operator at the surface and/or to a control module 28 in another zone 14, to indicate that the closure member 444 has successfully moved to the fully open position. Alternatively, one or more of steps 510 through 516 can be eliminated and the operational procedure 500 can progress to step 518 with the closure member 444 in the fully open position.

At step 518, fluids can be conveyed down-hole through interior passage 422. As indicated by arrows $A_3$ (FIG. 12A), these fluids can pass through the tubing port 450*b* into the interior passage 432 of the washpipe 430. In some embodiments, the fluids can be expelled from the lower opening 436 (FIG. 10A) in the washpipe 430 in a washdown gravel packing operation. In some embodiments, the fluids can be expelled from the washpipe 430 through perforations 434, and then into annular zone 14*e* through a port (not shown) disposed below the screen system 408. In some embodiments, a washdown gravel packing operation can be executed with each of the sleeve members 412 (FIG. 10A) in the respective closed position.

Figure 12B:
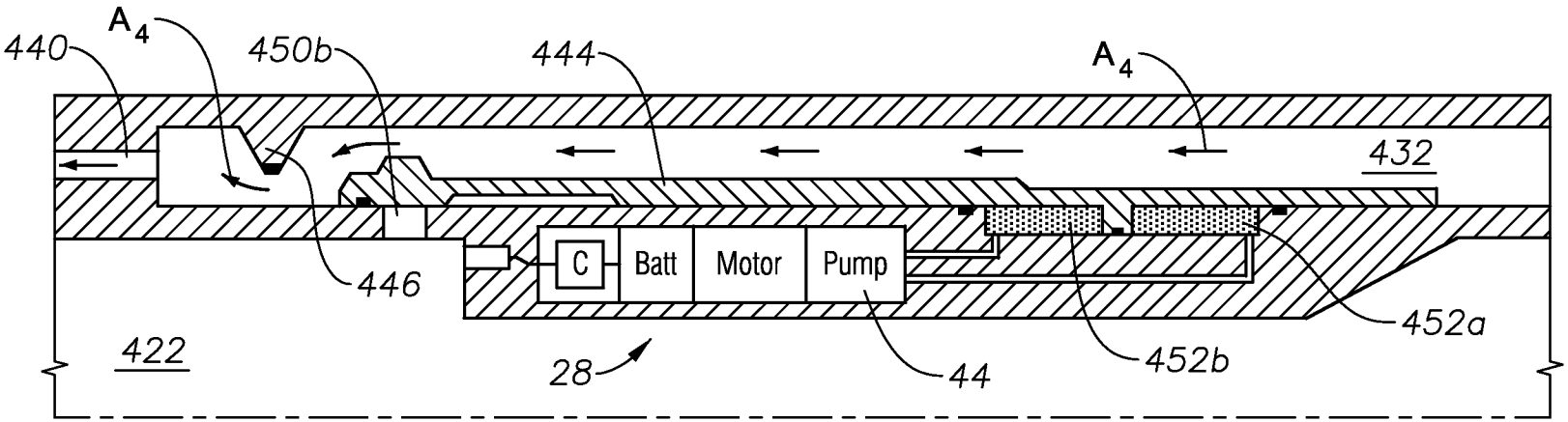

When the washdown gravel packing operation is complete, the operational procedure 500 can proceed to step 520 where a local activation signal can be generated within the wellbore 12, 202 to move the closure member 444 to a first closed position as illustrated in FIG. 12B. In some embodiments, the pump 44 may be operated to withdraw hydraulic fluid "H" from section 452*b* of the fluid chamber 452, and simultaneously provide hydraulic fluid "H" to section 452*a* of the fluid chamber 452. Executing these instructions may provide the local activation signal to urge the piston 454 toward the section 452*b*, and thereby move the closure member 444 in an up-hole direction from the fully opened position toward the first closed position. In some embodiments, the pump 44 is responsive to a series of instructions initiated by control module 28, and the control module 28 may execute these instructions in response to a signal transmitted from an operator at the surface or transmitted locally from within wellbore 12, 202.

Optionally, the operational procedure 500 can proceed to decision step 522 where errors can be detected. In one or more embodiments, the control module 28 can then check for errors, e.g., by querying feedback device 444*a*, 444*b* for a position of the closure member 444, and comparing the position returned with an expected position stored within the control module 28. If an error is detected at decision step 522, an error signal may optionally be sent at step 524, e.g., to an operator at the surface or locally to another location within the wellbore 12, 202, and various locations may be queried for instructions for responding to the specific error at step 526. If no errors are detected at decision step 522, a confirmation signal can be sent at step 528 to indicate that the closure member 444 has been successfully moved to the first closed position. Alternatively, one or more of steps 522 through 528 can be eliminated and the operational procedure 500 can progress to step 530 with the closure member 444 in the first closed position.

At step 530, with the closure member 444 in the first closed position, the tubing port 450*b* is obstructed by the closure member 444. Fluids can be conveyed up-hole through interior passage 432, past the molded sealing member 446 into return passage 440 as indicated by arrows $A_4$ (FIG. 12B). In some embodiments, the fluids can be received into the interior passage 432 through screen system 408, e.g., in a crossover gravel packing operation. In some embodiments, a crossover gravel packing operation can be executed with each of the sleeve members 412 (FIG. 10A) in the respective open position such that fluids can exit interior passage 422 through radial port 424 and enter the interior passage 432 through radial openings 414.

Figure 12C:
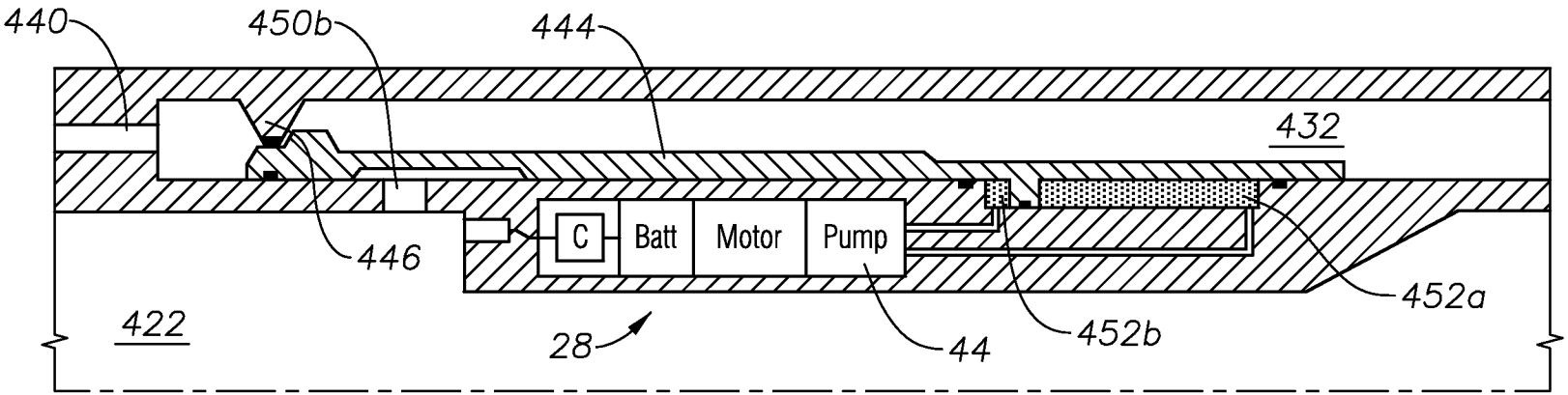

When the crossover gravel packing operation is complete, the closure member 444 can be moved to a second closed position (step 532) as illustrated in FIG. 12C. In some embodiments, an operator at the surface can again instruct the control module 28 to initiate a series of instructions that operate the pump 44 to withdraw hydraulic fluid "H" from section 452*b* of the fluid chamber 452, and simultaneously provide hydraulic fluid "H" to section 452*a* of the fluid chamber 452. Executing these instructions can urge the piston 454 toward the section 452*b*, and thereby move the closure member 444 in an up-hole direction from the first closed position toward the second closed position. The control module 28 can then again optionally check for errors at decision step 534. If an error is detected, an error signal may be transmitted at step 536 and various locations may be queried for instructions for responding to the specific error at step 538. If no errors are detected, a confirmation signal can be sent at step 540, indicating that the closure member 444 has been successfully moved to the second closed position.

With the closure member 444 in the second closed position, the closure member 444 engages the molded sealing member 446, obstructing flow between the interior passage 432 of the washpipe 430 and the return passage 440. The tubing port 450*b* remains obstructed by the closure member 444 when the closure member 444 is in the second closed position. Thus, fluid flow from the interior passage 432 is prevented allowing for hydraulic fracturing operations to proceed (step 542). The closure member 444 prevents pressurized hydraulic fracturing fluids from escaping up the interior passage 422 and the return passage 440.

When the hydraulic fracturing operation is complete, in some embodiments, the operational procedure 500 may proceed to step 544 where the sleeve members 412 may be shifted to an appropriate configuration (open or closed) for production, or for other wellbore operations as necessary. In some embodiments, the service tool 402 may be mechanically shifted to thereby shift the sleeve members 412 with the mechanical catch 438.

In an optional step 546, the service tool 402, which includes the wash pipe 430, the multi-position valve 404 and the control module 28, can be moved to an additional zone 14. For example, the service tool 402 can be shifted to zone 14*f*, which is located up-hole of the isolation system 406. In the zone 14*f*, the tubing port 450*b* of the washpipe 430 can be coupled to the interior passage 422 of the tubular string 420 and the return port 450*a* of the washpipe 430 can be coupled to a return passage (not shown) extending on an exterior of the tubular string 420. The procedure 500 can return to step 508 (step 548), where the service tool 402 can be reset in preparation for gravel packing operations and/or hydraulic fracturing operations to be performed in the zone 14*f*. The steps 508 through 548 can be repeated for each zone 14 in the wellbore.

In one aspect of the disclosure, an apparatus for controlling flow in a wellbore, includes a tubular string having a sidewall and defining an interior passage within the sidewall and an annular space around the sidewall. A first flow control tool is carried by the tubular string and includes a first hydraulic activation mechanism for changing an operational configuration of the first flow control tool. A first control line extends from the first hydraulic activation mechanism. A first control module is carried by the tubular string, and the first control module includes a reservoir for hydraulic fluid, a pump operable to deliver hydraulic fluid from the reservoir to the first control line and a controller operably coupled to the pump to instruct the pump to operate to deliver the hydraulic fluid through the at least one of the first and second control lines to the first activation mechanism.

In some exemplary embodiments, the first control tool includes an inflow control valve operable to regulate flow through an ICV opening defined through the sidewall of the tubular string. The first hydraulic activation mechanism may include a choke member operable to selectively adjust flow through the ICV opening. In some exemplary embodiments, the apparatus further includes an annulus pressure feedback device operable to provide an annulus feedback signal to the controller, wherein the annulus feedback signal is representative of a zonal pressure within the annular space, and wherein the controller is operable to receive the annulus feedback signal and to instruct the pump to operate based on annulus feedback signal to adjust the choke member. In some exemplary embodiments, the controller includes a non-transitory computer readable medium programmed with a predetermined threshold pressure and instructions for operating the pump thereon. The instructions for operating the pump can include instructions to adjust the choke member based on the annulus feedback signal and the predetermined threshold pressure. The controller can also include a processor operably coupled to the non-transitory computer readable medium and to the pump to instruct the pump to execute the instructions programmed on the non-transitory computer readable medium.

In some exemplary embodiments, the apparatus further includes a sand screen system disposed radially around the ICV opening. The apparatus may further include a frac port and a frac sleeve disposed radially and axially within the sand screen system. The frac port can extend through the sidewall of the tubular string and the frac sleeve can be operable independently of the choke member to permit or obstruct flow through the frac port.

In some exemplary embodiments, the apparatus can further include a second control module carried by the tubular string, the second control module operable to deliver hydraulic fluid to an additional flow control tool independently of the first control module. In some exemplary embodiments, the first control tool includes an inflow control device defining a tortuous path operable to create a pressure drop between the annular space and the interior passage, and the first activation mechanism includes an open-close valve operable to selectively permit and obstruct flow through the tortuous path. In some exemplary embodiments, the apparatus further includes a circulating valve interconnected within the tubular string, wherein the circulating valve is operable to selectively permit or restrict fluid flow through a radial port extending between the interior passage and the annular space by mechanically shifting an insert between open and closed positions.

In some exemplary embodiments, the apparatus further includes a second flow control tool carried by the tubular string, wherein the second flow control tool includes a second hydraulic activation mechanism for changing an operational configuration of the second flow control tool. A second control line extends from the second hydraulic activation mechanism, and at least one valve is selectively operable to establish and obstruct fluid communication between the pump and each of the first and second control lines. The controller can be operably coupled to the at least one valve to selectively instruct the at least one valve to establish fluid communication between the pump and the first and second control lines. The first control line can include a dual control line having a pair of passages disposed therein, and the at least one valve cab be operable to determine a flow direction of hydraulic fluid through each passage of the pair of passages.

In another aspect of the disclosure, a system for controlling flow in a wellbore includes a tubular string comprising a sidewall and defining an interior passage within the sidewall and an annular space around the sidewall. A first flow control tool is carried by the tubular string, and the first flow control tool includes a first hydraulic activation mechanism for changing an operational configuration of the first flow control tool. A control module is carried by the tubular string and is operably coupled to the first flow control tool by a first control line extending therebetween. The control module includes a reservoir for hydraulic fluid, a pump operable to deliver hydraulic fluid from the reservoir to the first control line, a non-transitory computer readable medium programmed with instructions for operating the pump thereon, and a processor operably coupled to the non-transitory computer readable medium and the pump to instruct the pump to execute the instructions programmed on the non-transitory computer readable medium.

In some exemplary embodiments, the first fluid flow control tool includes an inflow control valve operable to regulate flow through an ICV opening defined through the sidewall of the tubular string, and the first hydraulic activation mechanism comprises a choke member operable to selectively adjust flow through the ICV opening. The instructions on the non-transitory computer readable medium can include instructions to provide hydraulic fluid to the choke member of the inflow control valve to move the choke member to an open position.

In some exemplary embodiments, the control module further includes a wireless communication unit operably coupled to the processor, wherein the wireless communication unit is operable to transmit signals to a surface location and to receive signals from the surface location, and the instructions on the non-transitory computer readable medium can include instructions to provide hydraulic fluid to the choke member of the inflow control valve in response to receiving a START signal received by the communication unit. The system can further include an annulus feedback device operable to provide an annulus feedback signal to the processor, wherein the annulus feedback signal is representative of a zonal pressure within the annular space, and the instructions on the non-transitory computer readable medium can include instructions to provide hydraulic fluid to the choke member of the inflow valve based on the annulus feedback signal.

In some exemplary embodiments, the system can further include a second flow control tool carried by the tubular string, and the second flow control tool can include a second hydraulic activation mechanism for changing an operational configuration of the second flow control tool. A second control line may be provided extending from the second hydraulic activation mechanism, and at least one valve can be provided that is selectively operable to establish and obstruct fluid communication between the pump and each of the first and second control lines. The controller can be operable to instruct the at least one valve to establish fluid communication between the pump and each of the first and second control lines.

In another aspect, the present disclosure is directed to a method of controlling flow in a wellbore. The method includes (a) deploying a tubular string, a first flow control tool and a control module into the wellbore, and (b) instructing the control module to operate a pump therein to deliver hydraulic fluid to the first control tool thereby changing the operational configuration thereof.

In some exemplary embodiments, the method further includes operating the control module to transmit a wireless confirmation signal to the surface location subsequent to delivering hydraulic fluid to the first control tool to thereby change the operational configuration thereof. The method can further include transmitting a signal from the surface location to the control module to initiate instructing the control module to operate the pump.

In some exemplary embodiments the method further comprises deploying a second flow control tool and at least one valve into the wellbore, and instructing the controller to operate the at least one valve to establish fluid communication between the pump and the second flow control tool. The first flow control tool can include an inflow control valve, and the method can further include instructing the control module to operate the at least one valve to establish fluid communication with the inflow control valve, and instructing the control module to operate the pump to move a choke member of the inflow control valve and thereby regulate flow through an ICV opening of the inflow control valve. The method may further include detecting a pressure within an annular space within the wellbore with an annulus pressure feedback device of the control module, and instructing the control module to operate the pump to move a choke member can include operating the operating the pump to move the choke member based on the pressure detected.

In some exemplary embodiments, the first or second flow control tool includes an isolation member, and changing the operational configuration of the first or second control tool can include setting the isolation member within the wellbore.

Moreover, any of the methods described herein may be embodied within a system including electronic processing circuitry to implement any of the methods, or a in a computer-program product including instructions which, when executed by at least one processor, causes the processor to perform any of the methods described herein.

The Abstract of the disclosure is solely for providing the United States Patent and Trademark Office and the public at large with a way by which to determine quickly from a cursory reading the nature and gist of technical disclosure, and it represents solely one or more embodiments.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed is:

1. An apparatus for controlling flow in a wellbore, comprising:

a tubular string comprising a sidewall and defining an interior passage within the sidewall and an annular space around the sidewall;

a first flow control tool carried by the tubular string, the first flow control tool comprising a first hydraulic activation mechanism for changing an operational configuration of the first flow control tool;

a first control line extending from the first hydraulic activation mechanism; and a first control module carried by the tubular string, the first control module comprising:

a reservoir for hydraulic fluid;

a pump operable to deliver hydraulic fluid from the reservoir to the first control line; and a controller operably coupled to the pump to instruct the pump to operate to deliver the hydraulic fluid through the at least one of the first and second control lines to the first activation mechanism.

2. The apparatus of claim 1, wherein the first control tool comprises an inflow control valve operable to regulate flow through an ICV opening defined through the sidewall of the tubular string, and wherein the first hydraulic activation mechanism comprises a choke member operable to selectively adjust flow through the ICV opening.

3. The apparatus of claim 2, further comprising an annulus pressure feedback device operable to provide an annulus feedback signal to the controller, wherein the annulus feedback signal is representative of a zonal pressure within the annular space, and wherein the controller is operable to receive the annulus feedback signal and to instruct the pump to operate based on annulus feedback signal to adjust the choke member.

4. The apparatus of claim 3, wherein the controller comprises a non-transitory computer readable medium programmed with a predetermined threshold pressure and instructions for operating the pump thereon, the instructions for operating the pump including instructions to adjust the choke member based on the annulus feedback signal and the predetermined threshold pressure; and a processor operably coupled to the non-transitory computer readable medium and to the pump to instruct the pump to execute the instructions programmed on the non-transitory computer readable medium.

5. The apparatus of claim 2, further comprising a sand screen system disposed radially around the ICV opening.

6. The apparatus of claim 5, further comprising a frac port and a frac sleeve disposed radially and axially within the sand screen system, the frac port extending through the sidewall of the tubular string and the frac sleeve operable independently of the choke member to permit or obstruct flow through the frac port.

7. The apparatus of claim 1, further comprising a second control module carried by the tubular string, the second control module operable to deliver hydraulic fluid to an additional flow control tool independently of the first control module.

8. The apparatus of claim 1, wherein the first control tool comprises an inflow control device defining a tortuous path operable to create a pressure drop between the annular space and the interior passage, and wherein the first activation mechanism comprises an open-close valve operable to selectively permit and obstruct flow through the tortuous path.

9. The apparatus of claim 1, further comprising:

a second flow control tool carried by the tubular string, the second flow control tool comprising a second hydraulic activation mechanism for changing an operational configuration of the second flow control tool;

a second control line extending from the second hydraulic activation mechanism; and at least one valve selectively operable to establish and obstruct fluid communication between the pump and each of the first and second control lines, wherein the controller is operably coupled to the at least one valve to selectively instruct the at least one valve to establish fluid communication between the pump and the first and second control lines.

10. The apparatus of claim 9, wherein at least one of the first control line and the second control line comprises a dual control line having a pair of passages disposed therein, and wherein the at least one valve is operable to determine a flow direction of hydraulic fluid through each passage of the pair of passages.

11. A system for controlling flow in a wellbore, comprising:

a tubular string comprising a sidewall and defining an interior passage within the sidewall and an annular space around the sidewall;

a first flow control tool carried by the tubular string, the first flow control tool comprising a first hydraulic activation mechanism for changing an operational configuration of the first flow control tool;

a control module carried by the tubular string and operably coupled to the first flow control tool by a first control lines extending therebetween, the control module comprising:

a reservoir for hydraulic fluid;

a pump operable to deliver hydraulic fluid from the reservoir to the first control line;

a non-transitory computer readable medium programmed with instructions for operating the pump thereon; and a processor operably coupled to the non-transitory computer readable medium and the pump to instruct the pump to execute the instructions programmed on the non-transitory computer readable medium.

12. The system of claim 11, wherein:

the first fluid flow control tool comprises an inflow control valve operable to regulate flow through an ICV opening defined through the sidewall of the tubular string, and wherein the first hydraulic activation mechanism comprises a choke member operable to selectively adjust flow through the ICV opening; and the instructions on the non-transitory computer readable medium include instructions to provide hydraulic fluid to the choke member of the inflow control valve to move the choke member to an open position.

13. The system of claim 12, wherein:

the control module further comprises a wireless communication unit operably coupled to the processor, the wireless communication unit operable to transmit signals to a surface location and to receive signals from the surface location, and the instructions on the non-transitory computer readable medium include instructions to provide hydraulic fluid to the choke member of the inflow control valve in response to receiving a START signal received by the communication unit.

14. The system of claim 12, further comprising an annulus feedback device operable to provide an annulus feedback signal to the processor, wherein the annulus feedback signal is representative of a zonal pressure within the annular space, and wherein the instructions on the non-transitory computer readable medium include instructions to provide hydraulic fluid to the choke member of the inflow valve based on the annulus feedback signal.

15. A method of controlling flow in a wellbore, comprising:

(a) deploying a tubular string, a first flow control tool and a control module into the wellbore; and (b) instructing the control module to operate a pump therein to deliver hydraulic fluid to the first control tool thereby changing the operational configuration thereof.

16. The method of claim 15, further comprising operating the control module to transmit a wireless confirmation signal to the surface location subsequent to delivering hydraulic fluid to the first control tool to thereby change the operational configuration thereof.

17. The method of claim 15, further comprising transmitting a signal from the surface location to the control module to initiate instructing the control module to operate the pump.

18. The method of claim 15, further comprising: deploying a second flow control tool and at least one valve into the wellbore; and instructing the controller to operate the at least one valve to establish fluid communication between the pump and the second flow control tool.

19. The method of claim 18, wherein the first flow control tool comprises an inflow control valve, and wherein the method further comprises instructing the control module to operate the at least one valve to establish fluid communication with the inflow control valve, and instructing the control module to operate the pump to move a choke member of the inflow control valve and thereby regulate flow through an ICV opening of the inflow control valve.

20. The method of claim 19, further comprising detecting a pressure within an annular space within the wellbore with an annulus pressure feedback device of the control module, and wherein instructing the control module to operate the pump to move a choke member comprises operating the operating the pump to move the choke member based on the pressure detected.

* * * * *